US009302741B2

(12) United States Patent
Hinkel

(10) Patent No.: US 9,302,741 B2
(45) Date of Patent: Apr. 5, 2016

(54) RETRACTABLE KEEL APPARATUS

(76) Inventor: Ralf Hinkel, Höringen (DE)

( * ) Notice: Subject to any disclaimer, the term of this patent is extended or adjusted under 35 U.S.C. 154(b) by 64 days.

(21) Appl. No.: 13/984,915

(22) PCT Filed: Feb. 10, 2012

(86) PCT No.: PCT/EP2012/000612

§ 371 (c)(1),
(2), (4) Date: Oct. 17, 2013

(87) PCT Pub. No.: WO2012/107237

PCT Pub. Date: Aug. 16, 2012

(65) Prior Publication Data

US 2014/0026795 A1 Jan. 30, 2014

(30) Foreign Application Priority Data

Feb. 10, 2011 (DE) ..... 10 2011 010 942
Sep. 19, 2011 (DE) ..... 10 2011 113 561

(51) Int. Cl.
*B63B 41/00* (2006.01)
*B63B 3/38* (2006.01)
*B63B 43/18* (2006.01)

(52) U.S. Cl.
CPC . *B63B 3/38* (2013.01); *B63B 41/00* (2013.01); *B63B 43/18* (2013.01); *B63B 2221/24* (2013.01)

(58) Field of Classification Search
USPC ..... 114/141
IPC ..... B63B 41/00,3/38
See application file for complete search history.

(56) References Cited

U.S. PATENT DOCUMENTS 3,175,473 A * 3/1965 Boteler et al. ..... 92/128
6,441,735 B1 * 8/2002 Marko et al. ..... 340/542
6,553,336 B1 * 4/2003 Johnson et al. ..... 702/188

FOREIGN PATENT DOCUMENTS

DE 29 04 130 A1 8/1980
EP 0 816 219 A2 1/1998
EP 0 941 919 A1 9/1999
EP 2 055 628 A2 5/2009
GB 1 272 543 A 5/1972
WO 83/02760 A1 8/1983
WO 2009/034595 A1 3/2009
WO 2009/058026 A1 5/2009

* cited by examiner

*Primary Examiner* — Stephen Avila
(74) *Attorney, Agent, or Firm* — McGlew and Tuttle, P.C.

(57) ABSTRACT

A retractable keel apparatus for a ship, in particular for a sailboat, including a lift device for a lowerable and retractable fin device having a fin (4) and a fin head plate (20) disposed thereon, the fin head plate making contact with a keel receptacle (5) provided for permanently attaching to a hull when the fin is lowered, the receptacle further having a locking device by which releasable locking can be produced between the fin head plate (20) and the keel receptacle (5). The invention should be designed such that, despite greater stability, including in the event of a crash, the device can be produced and integrated in ships as simply and cost-effectively as possible. For this purpose, the locking device has at least one, preferably a plurality of, preferably driven, longitudinally displaceable locking bolts (15) that can be displaced along a diagonally running displacement path.

20 Claims, 16 Drawing Sheets

RETRACTABLE KEEL APPARATUS

CROSS REFERENCE TO RELATED APPLICATIONS

This application is a United States National Phase application of International Application PCT/EP2012/000612 filed Feb. 10, 2012 and claims the benefit of priority under 35 U.S.C. §119 of German patent application DE 10 2011 010 942.0 filed Feb. 10, 2011 and German patent application DE 10 2011 113 561.1 filed Sep. 19, 2011, the entire contents of each application are incorporated herein by reference.

FIELD OF THE INVENTION

The invention relates to a retractable keel apparatus for a ship, in particular for a sailboat, having a lift device for a lowerable and retractable fin device, which is provided with a fin and a fin head plate arranged thereon. With the fin lowered, the fin head plate comes into contact with a keel receptacle, which is provided for permanent connection to a ship's hull, which is also provided with a locking device with which a releasable lock can be created between the fin head plate and keel receptacle. The invention also relates to ships provided with such a retractable keel.

BACKGROUND OF THE INVENTION

The hull of a ship, in particular a sailboat, is often provided with a keel. A keel imparts a greater stability to a ship in particular, and in the case of sailboats, an uprighting torque is created against the wind force acting on the sail and lateral drift is reduced. Since the keel increases the draft of a ship and thus the ship can run onto ground in a shallower body of water, for example, in ports and in near-shore areas, retractable keels have already been developed for larger sailboats, so that the keel is extracted from the hull by means of a driven lift device and can be retracted into the hull at a lesser depth of water.

The construction and practical manufacturing of a movable keel have proven to be extremely complex and difficult however because of some general boundary conditions in shipbuilding. The keel ensures the stability of a ship and should therefore typically constitute 30-40% of the total weight of a ship, thus necessitating a suitably dimensioned lift device for the retraction or extraction of the keel as well as a stable receptacle for anchoring and locking the keel to the hull of the ship. Because of the enormous forces prevailing in and on the keel, in particular as a counterweight on sailboats, the keel itself must be constructed and manufactured with a high level of stability. Unanticipated collision or contact with obstacles (e.g., rocks) in the water has been considered to be one of the most difficult scenarios to control. Such a so-called crash must be absorbed without any major destructive effect.

In addition, the securing and/or locking of the keel in the receptacle in the extracted position must be smooth running at all times and must also function even after a crash. This is not the case with the known retractable keel, because the keel is secured by the guidance of the lift device, e.g., by a hydraulic lift cylinder and/or one or more locking bolts arranged horizontally which cannot usually withstand the loads in a crash and are destroyed. To counteract this, the lift devices are usually over-dimensioned in relative to the actual lift function, which has a negative effect on costs and installation height.

Another disadvantage of this previously known lifting and securing arrangement with horizontal locking bolts is already apparent from the normal use in normal seas because the guidance of the lift devices and/or the horizontal locking bolts must be knocked out and replaced quickly. However it is practically impossible to accurately manufacture locking bolts which prevent removal from the beginning while at the same time permitting easy locking even when the keel has not been extracted in a precisely accurate manner.

Another disadvantage of the known retractable keels may be regarded as the fact that they require an excessive dimensioning in relation to the size of the hull because of the requirements described above and they take up a great deal of space in the interior of the ship so that it is often difficult for people to pass by the hull.

Such driven retractable keels can be found today only on special designs because the requirements and problems mentioned above make it difficult to have a simple enough cost-efficient production of such movable keels. The high construction and manufacturing costs prevent large scale use in shipbuilding.

SUMMARY OF THE INVENTION

An object of the present invention is therefore to create a retractable keel of the aforementioned type which can be manufactured, maintained and integrated into ships as easily and as cost-efficiently as possible, even in the event of a crash.

This object is achieved according to the invention with a retractable keel apparatus of the type defined in the introduction by a form-fitting connection between the fin device and the keel receptacle in the extracted state of the fin device as well as by the locking device with which the fin head plate is held in its form-fitting arrangement. The locking device should be present as an additional element—in addition to and independently of the form-fitting connection—which locks the fin head plate in its extracted end position after the form-fitting connection has been established. The form-fitting connection may be created in various ways, for example, by the fact that a form-fitting connection to the keel receptacle or to an element operatively connected to the latter is created with the fin head plates itself. Another possibility is to mount one or more form-fitting elements on the fin head plate that are provided for a form-fitting engagement in corresponding mating elements on the keel receptacle. Such form-fitting elements may be plugs in particular, which extend at least essentially perpendicularly downward from the fin head plate and engage in one or more corresponding recesses in the keel receptacle. The pegs and recesses may of course also be exchanged. It is preferable here if the form-fitting connection has conical elements in particular with a slope which facilitates secure engagement despite the possible play between the elements responsible for the form-fitting connection.

As a result of this measure, conditions resembling those with a fixed keel are also achieved with retractable keels in the extracted state for the forces introduced into the boat through the fin mechanism—despite the lifting option of the fin device. The connection created by this locking should preferably accomplish the most direct possible operative connection between the fin device and that part of the boat structure that is capable of decreasing the forces preferably without damage to the boat. With a traditional design of the ship's hull this refers in particular to the longitudinal and transverse spans of the hull. It is possible in this way in particular to avoid a direct introduction of force into the deck, where there is the risk of damage more readily than with the structure of the side walls of the ship's hull so that the crash forces on the retractable keel should be diverted directly and thus completely into the deck.

A structurally favorable operative connection can be created by a driven movement in which the liftingly movable fin device is bolted or screwed into a keel receptacle that is connected to the bottom group of the ship's structure. Such a driven movement may be in particular a hydraulically drive movement. The forces occurring on the ballast weight of the fin device due to the rolling and pitching movements of the ship are directed mainly at a right angle to the fin and not in the direction of the vertical axis of the fin. Therefore, the fin is exposed essentially to torquing. Due to the requirement for a good hydrodynamic profile, the resulting forces at the end of the fin are especially great in lateral movements due to rolling of the ship because of the unfavorable leverage ratio of the fin thickness to the fin length which is typically 1:5. Due to the preferred form-fitting connection between the fin head plate and the ship's bottom, it is possible to convert the forces on the fin which originally act laterally and are applied as a torque into forces acting vertically and could thereby reduce them to one quarter as well as diverting them into the ship's bottom. It is therefore advantageous if a device is provided with which the fin device is held in the form-fitting connection, in particular the tenon dowel joint. Essentially the lift cylinder of the lift device can also be used for forcing the fin device into the form-fitting connection. Then however possible crash forces would act on the lift cylinder causing it to buckle and would thus endanger the lift cylinder. It is therefore preferably if a locking device is provided which ensures, independently of the lift cylinder for the fin, that the form-fitting connection is also upheld even in the event of a crash. In particular with smaller boats which offer little room for mounting a separate locking device, the lift cylinder may nevertheless assume the task of the locking device to be able to achieve the advantages of the present invention with such boats as well. The connection may preferably be embodied as a releasable form-fitting connection between the bottom group of the retractable keel apparatus which is permanently connected to the ship's structure, and the fin device of the retractable keel apparatus with which the forces of the fin device can be introduced into and transferred to the ship's bottom. Such a form-fitting connection may be designed in particular as a form-fitting tenon dowel joint. It is especially advantageous here if the tenon dowel joint provided between the fin device and the ship's bottom has at least essentially vertically aligned dowels with which the loads acting on the joint can be absorbed especially well and diverted into the ship's structure. In this context, the term "vertical" is to be understood to refer to an alignment running parallel to the vertical axis of the boat and/or of the fin.

A preferred embodiment of the tenon dowel joint may have a conical design so that it can be released well and so that ceasing of the tenon dowel joint can be prevented. A portion of the lateral torque of the fin is thereby deflected in the direction of the dowels and/or the fin vertical axis in accordance with the cone ratio. The leverage ratio of the fin length to the dowel length may advantageously be between 1:10 and 20:1 and may also correspond at least approximately to the cone ratio of 20:1 to 40:1, so that the amount of the resulting vertical forces corresponds at most to the amount of the horizontal forces acting on the ballast weight.

According to another aspect of the invention, the object of the invention is also achieved according to the invention with a retractable keel apparatus of the type defined in the introduction by the fact that the locking device is provided with at least one, preferably with several driven longitudinally displaceable locking bolts movable along on inclined displacement path. The locking device preferably has several locking bolts aligned in this way. Inclined is understood here to refer to an orientation of the displacement path that is different from the horizontal or the vertical.

It is preferable here if these at least one driven locking bolt is arranged in the keel's receptacle and acts on the fin head plate for locking same when it is activated.

To be able to absorb crash forces there especially well, in particular where these forces are greatest in the area of the locking device, it is possible in a preferred embodiment to provide for the distance between the locking bolts and/or the number of locking bolts not to be the same but instead for the distance between the bolts to be smaller and/or the number of bolts to be higher in the area where the highest forces are to be expected in the event of a crash.

A further increase in the ability to absorb crash forces can be achieved in an advantageous embodiment of the invention by the fact that an arrangement for moving the locking bolts has a hydraulic cylinder and a deformation element and the deformation element is designed so that it can absorb energy transferred over the bolt and thereby dissipated entirely or partially.

Furthermore, it is preferable for the locking bolt(s) to be designed as the piston of a hydraulic cylinder, in which the cylinder(s) is/are designed in the receptacle itself and optionally has/have a deformation element integrated into the cylinder. With such a design compact locking devices that are fully integrated into the keel receptacle can be designed with which high crash forces can be absorbed and dissipated despite the compact design.

In a preferred embodiment, the cylinder of the locking piston has a plurality of fluid connections, in particular at least two fluid connections such that one of the fluid connections may be provided for supplying fluid during regular operation of the locking device and at least one other fluid connection is provided for supplying fluid by means of a manually operated pump and/or a fluid connection for discharging fluid under an excess pressure.

This object is also achieved through another embodiment of the retractable keel apparatus according to the invention, in which the locking device is provided with at least one locking bar, preferably a plurality of locking bars, which can be brought against a top side of the fin device to thereby exert a hold-down force on the fin device, said hold-down force having at least one vertical component. A retractable keel apparatus designed according to this aspect of the invention may turn out to be especially simple in design with respect to the locking device, while nevertheless holding the fin device securely.

A locking bar that can be brought toward a top side of the fin device, in particular against a top side of the fin head plate, makes it possible to provide other drive movements for the lock than are possible with bolts, which must be inserted into lateral recesses in the fin head plate to produce a locking effect. A locking bar brought into contact with an external surface of the fin, in particular a surface at the top of the fin head plate, can be brought into this position, which locks the extracted fin in the bearing position of the pivotable locking bar, which is designed as a pivot axis, by a pivoting movement about this bearing point in particular. In this way it is also possible expediently to provide that the pivoting movement may take place in the form of a driven movement, in particular a hydraulically driven movement, for example, by means of a hydraulic cylinder which acts at least on one locking bar. In this way it is possible to convert the hydraulically generated force to a hold-down force which actually acts on the fin so that the initial forces generated hydraulically may be lower.

A hydraulic cylinder preferably acts directly on the at least one locking bar with a distance from the pivot axis which then acts as a lever, pivoting the locking bar into its locking position and preferably also into its position releasing the fin. The largest possible lever can keep the required hydraulic forces as low as possible, so that the design complexity of the drive of the locking bars can be kept low. A similar effect and/or an increase in the lever action can also be created by possible insertion of gears or by deflection between the hydraulic cylinder and the at least one locking bar. Likewise, a bearing support of the at least one locking bar on its pivot axis with the lowest possible friction may also contribute toward this.

In another preferred embodiment, the at least one locking bar may be provided with devices by means of which the locking bar is capable of executing at least one of four functions, preferably all four functions described below. In closing, it preferably presses a fin, which might have been extracted too far downward into its ideal position for locking, using collecting means designed as a collecting surface. With bearing means that are preferably designed as a bearing surface of the locking bar, the latter holds the fin down. With equalizing means, any play between the locking bar and the fin that is present in the locking position can be compensated. To do so, the at least one locking bar may in particular have a compensating surface which comes in contact with the fin device, in particular with the fin head plate in the remaining course of the movement of the locking bar into its locked position, and the possible play is compensated by subsequently pressing on the fin device. Finally, ejection means may also be provided, by means of which the locking bar provides support in cancelling the lock to release the fin device from its locked position and thereby allow a fin device, which might have been "frozen" in position, to be movable again by the lift device. The ejection means may be separate ejector cylinders or other means with which the fin device can be lifted out of the form-fitting connection. However it is preferable here for the ejector means to have an ejector surface mounted on the at least one locking bar, bringing the locking bar out of its position locking the fin device into a position releasing the fin device, coming in contact with the fin device and lifting it at least slightly. The drive of the locking bar may thus also be utilized to release a fin device that might be "frozen" in place. The locking device in this preferred embodiment of the invention not only contributes toward a high functional reliability of the lift device of the fin device, but also contributes toward the lift device not having to be dimensioned to be able to lift it out of its extracted position only with greatly increased lifting forces. Such greatly increased lifting forces in comparison with the force of gravity may also occur due to additional frictional forces which are to be overcome in releasing the form-fitting connection of the fin device to the keel receptacle. With this known preferred embodiment of the invention, such forces may be overcome without any additional structural effort because the opening movement of the at least one locking bar is utilized to this end.

In another favorable embodiment of the invention, the at least one locking bar may be provided with a groove-shaped recess which can hold an edge area of the fin head plate, in particular holding it in such a way that a bearing surface formed on the inside of the groove can be brought into contact with a top side of the fin head plate. The aforementioned means, in particular surfaces for implementing the functions, namely as many as four functions, may be provided as bordering surfaces of the groove-shaped recess. One or more of the three surfaces, namely the collecting surface, the bearing surface and the equalizing surface may be designed as the upper bordering surfaces—or as a part thereof—of the groove-shaped recess. The ejector surface however may advantageously be provided as the lower bordering surface—or as least a portion thereof—of the groove-shaped recess.

According to another aspect of the present invention, which also has independent importance, the object is also achieved by a retractable keel apparatus for a ship, in particular for a sailboat, having a lift device for a lowerable and retractable fin device, which is provided with a fin and with a fin head plate arranged thereon such that the fin head plate comes to rest against a keel receptacle which is provided for a permanent connection with a ship's hull when the fin is lowered, this keel receptacle also being provided with a locking device with which a releasable lock can be formed between the fin head plate and the keel receptacle, so that in the event of a crash, a force flow runs from the fin into its fin head and then through the locking device into the keel receptacle into the hull of the ship.

According to another aspect of the invention, which also has independent importance, the object is also achieved by a retractable keel apparatus for a ship, in particular for a sailboat which has a lowerable and retractable fin device, which is provided with a fin and a ballast body arranged on the fin such that a connection between the fin and the ballast body is implemented as a form-fitting connection.

According to yet another aspect of the invention, which also has independent importance, the object is also achieved by a retractable keel apparatus for a ship, in particular for a sailboat, which is provided with means for predetermined deformation in the event of a crash, by means of which crash energy can be absorbed in the form of deformation energy. The at least one means which is deformable in a predetermined and targeted manner may have different designs here and may be arranged in different locations of the retractable keel apparatus.

A preferred option here consists of providing the ballast body with a crushable zone in the front area which can absorb energy through deformation. The crushable zone here is preferably replaceable and should be easily replaceable after a crash.

Means for targeted energy absorption at predetermined sites on the retractable keel apparatus may however also be advantageously provided in the area of the locking device. The locking bolts in particular can be designed through a suitable geometry and/or a suitable material in a section of the locking bolt, so that deformation occurs at these locations in the event of a crash. Likewise, pistons that are deformable in a predetermined manner may also be provided between a drive cylinder for the locking bolts. Through such means with which crash energy can be absorbed through targeted deformation at predetermined locations, damage to the retractable keel apparatus can then be prevented at least in other areas if the crash forces are not excessively great. However even if the crash forces exceed the energy that can be absorbed with the absorption means according to the invention, then lower damage to the retractable keel apparatus and/or the ship's hull can be caused by the measure according to the invention and can be eliminated with less effort than in the past.

According to yet another aspect of the invention, this object is also achieved with a retractable keel apparatus according to the present invention by the fact that guidance of the fin with the prestress guide elements in particular adjustable prestress guide elements is in contact with the fin. In this way, an advantageous centering of the fin can be achieved with its retraction and extraction movements, on the one hand, and tilting of the fin can be prevented, while on the other hand, the guide can be accurately adjusted and set at any time.

According to yet another aspect of the invention, which also has independent importance, this object is achieved with a retractable keel apparatus according to the present invention in that when the fin is retracted the ballast body is in form-fitting contact with the keel receptacle. This can be achieved, for example, by corresponding surfaces of the keel receptacle and of the ballast body with which these are in contact with one another. In this way beating of the fin against the keel receptacle and the resulting possible damage to the ship can be prevented.

According to yet another aspect of the invention, which also has independent importance, the object is also achieved by a fin device for a retractable keel apparatus which is provided with a fin and with a fin head plate and ballast body arranged thereon such that a load-bearing structure of the fin is created from one or more profiles, preferably strand drawn profiles. Tubes which are connected to one another and are in contact with one another in parallel in particular, preferably being welded together are advantageously used as the profiles. The profile should be aligned so they at least approximately have their longitudinal extent parallel to the longitudinal extent of the fin. Since the fin has different widths because of its hydrodynamically favorable shape, profiles of different cross-sectional shapes and/or sizes can be used to advantage to form a load-bearing structure for a fin.

A load-bearing structure of such a design for a fin can be planked more easily than before, in particular since any load-bearing properties of the planking need not be taken into account for the planking. The planking may be selected and designed simply on the basis of its hydrodynamic properties.

In the state of the art, fins are usually constructed of multiple webs which are planked. The planking here consists of boards adapted to the desired geometry, which is usually hydrodynamic. The fin carries the weight of the ballast body and therefore the webs and the planking must be designed to be thick accordingly. The planking is a self-supporting element in the state of the art. However, this entails problems in manufacturing, e.g., difficulties in adjusting the planking to the target shape or processing of the last lateral surface because the connecting points to be manufactured (e.g., welds) are no longer accessible.

The present invention proposes as a solution to this problem that the structural supports of the keel construction of the fin be made of extruded profiles preferably relying on standard sizes that are customary in the industry. This has the advantage that the load-bearing construction parts of the fin can be manufactured inexpensively and in practically any desired wall thickness, diameter and length. In addition, in contrast with the web construction, joining of the profiles before planking can be performed in a manner that simplifies the manufacturing process. The planking may then be implemented with much thinner material because the planking need no longer have load-bearing properties but instead is needed only for sealing purposes. Thinner materials may also be converted to the desired shape more easily.

According to yet another aspect of the invention, which also has independent importance, the object is also achieved by a design and construction comprising a keel box and a guide block, such that the guide block and the keel box form a linear guide which is replaceable from above when the retractable keel is retracted.

Additional preferred embodiments of the invention are derived from the claims, the description and the drawings. Preferred embodiments of the invention also relate in particular to ships equipped with the retractable keel apparatus according to the invention.

In conjunction with the present invention, each of the features indicated may have independent importance or may be important when combined with one or more of the features given here.

The various features of novelty which characterize the invention are pointed out with particularity in the claims annexed to and forming a part of this disclosure. For a better understanding of the invention, its operating advantages and specific objects attained by its uses, reference is made to the accompanying drawings and descriptive matter in which preferred embodiments of the invention are illustrated.

DESCRIPTION OF THE PREFERRED EMBODIMENTS

Figure 1:
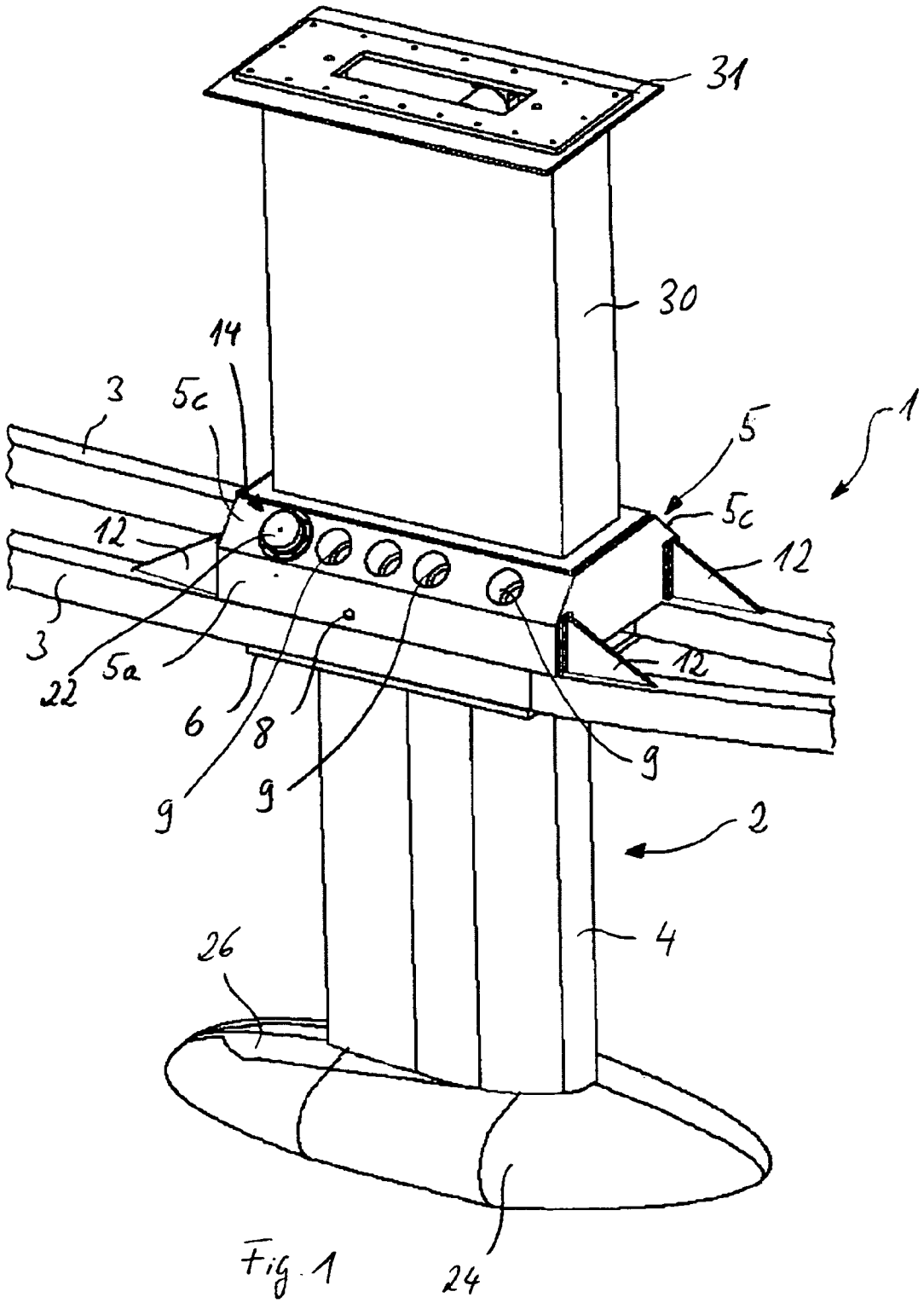
FIG. 1 is a view of a retractable keel apparatus according to the invention.
Figure 2:
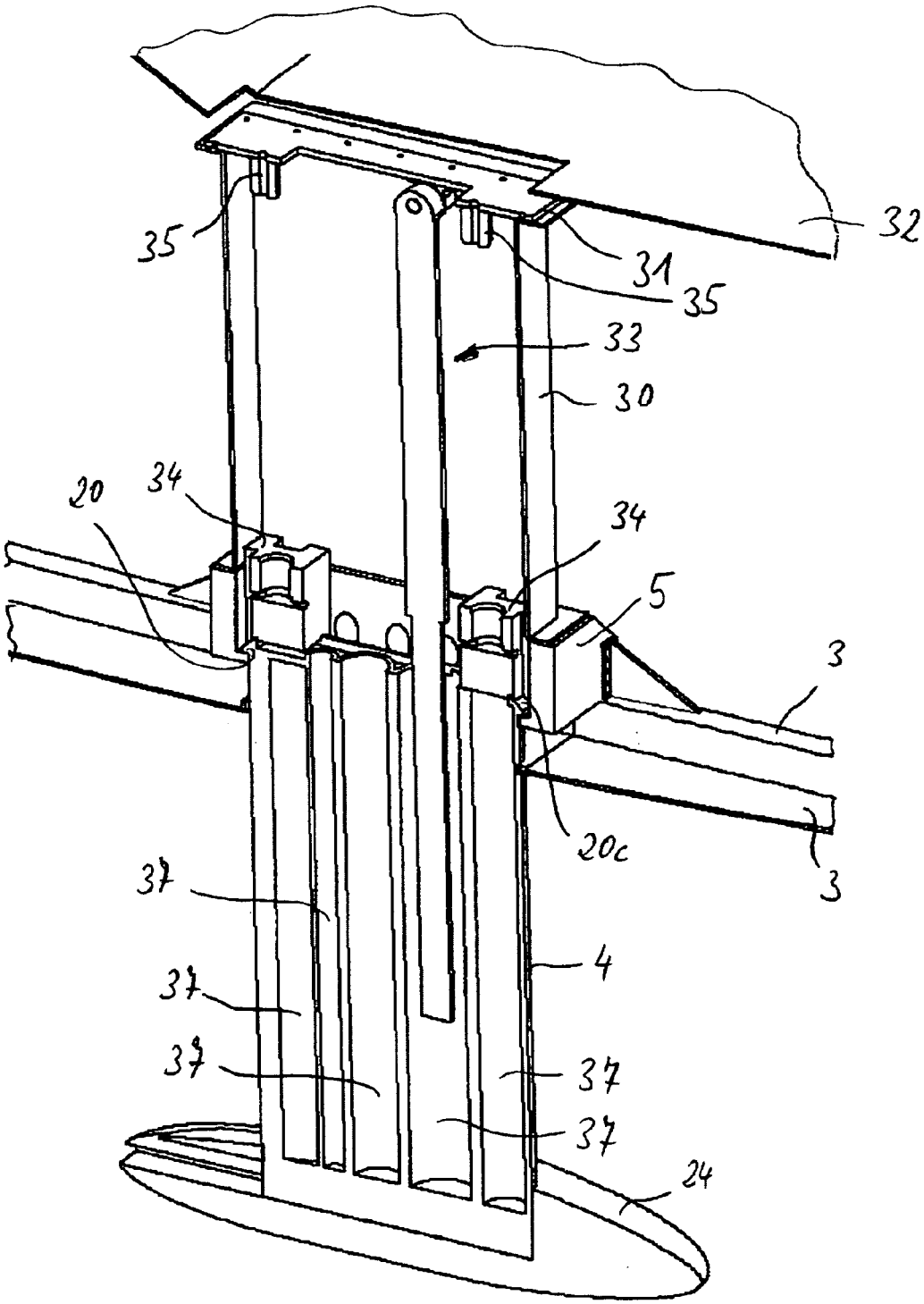
FIG. 2 is a longitudinal sectional view through the retractable keel apparatus from FIG. 1.

Referring to the drawings in particular, FIGS. 1 and 2 show a preferred embodiment of a retractable keel apparatus 1 according to the invention, enclosing a fin device 2. The retractable keel apparatus 1 is attached to the inside of a ship's hull, which is shown here only partially attached in a manner to be explained in greater detail below. These diagrams show only two longitudinal bulkheads 3, arranged with a distance between them, of the structure of the ship's hull on which the retractable keel apparatus 1 is attached and between which a fin 4 of the fin device 2 belonging to the retractable keel apparatus 1 is passed. In the diagram in FIG. 1, additional load-bearing components of a ship's hull such as additional longitudinal bulkheads and transverse bulkheads as well as the planking of the ship's hull are not shown in the diagram in FIG. 1.

Figure 9:
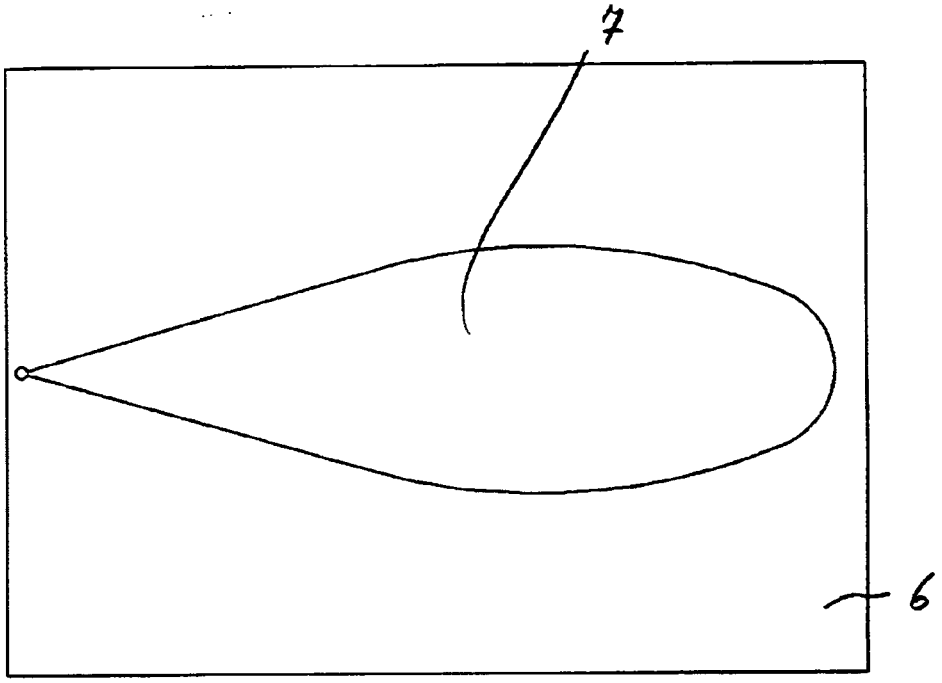
FIG. 9 is a view of a curtain panel in a view from above.

The retractable keel apparatus 1 according to the invention has a keel receptacle 5, which is shown in FIG. 1 and is approximately box-shaped with respect to its external form and can be attached to the ship's hull by bolts or other methods. Alternatively, the keel receptacle may also be integrated into the ship's hull in one piece, which may be the case in particular with a plastic hull. A bushing which functions as a crank is present centrally in box-shaped keel receptacle, its cross-sectional shape corresponding at least approximately to the cross-sectional shape of a fin of the retractable keel apparatus. The crank 7 shown in FIG. 9 is inserted into a crank plate 6 which is located on the bottom side of the longitudinal bulkhead 3. Since the fin 4 should preferably have a cross-sectional shape designed to be hydrodynamically favorable, the crank 7 will also have such as cross-sectional shape, for example, an approximately droplet-shaped cross-sectional shape. The cross-sectional shapes may be identical, where the cross sections differ only with respect to their sizes inasmuch as the fin 4 can be moved in the crank 7 without being damaged. The crank 7 may be provided with a peripheral cuff for sealing it against penetrating water. The retractable keel apparatus 1 according to the invention may also be provided with a device for detecting and removing water penetrating into the area of the crank 7 of the keel receptacle so that penetrating water can preferably be detected by means of one or more detection units (not shown) and can be removed by means of a pump (also not shown) through an opening 8 in the keel receptacle.

Side walls of the keel receptacle 5 extend upward on all sides from the edge of the crank 7. Thus the crank 7 is surrounded by the side walls on all sides without a gap. Two side walls are oriented parallel to one another in the longitudinal direction of the ship's hull as well as across that, such that the side walls 5*a*, 5*b* running in the longitudinal direction of the ship's hull have the greater length.

Figure 3:
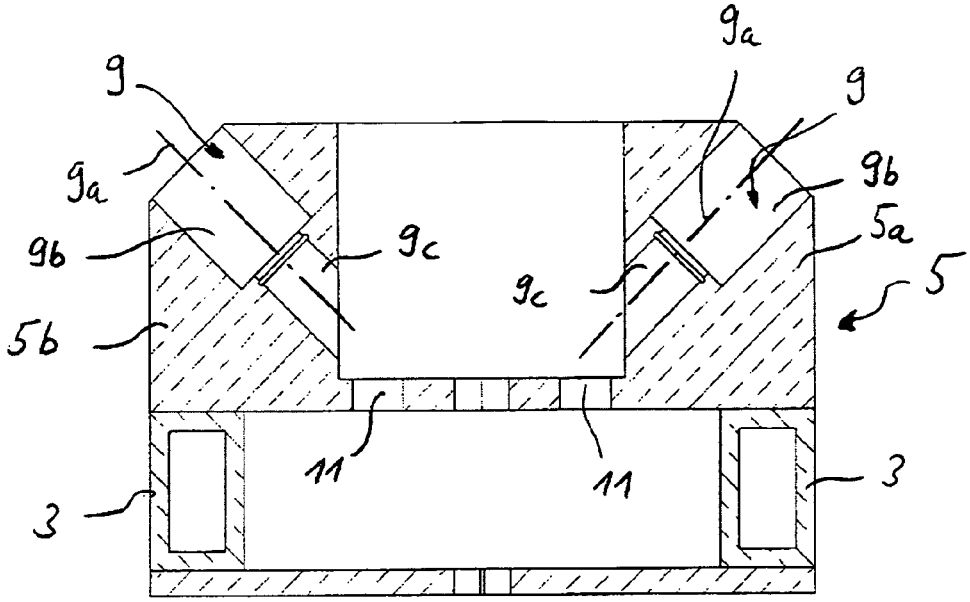
FIG. 3 is a cross sectional view through a keel receptacle from FIG. 1.

FIG. 3 shows a possible preferred embodiment of the keel receptacle 5 in a cross-sectional view. As this shows, the side walls 5*a*, 5*b*, which run in the longitudinal direction of the ship's hull, have chamfered upper outer side edges 5*c*, from which several continuous recesses 9, for example, through-holes having a circular cross section, are inserted into each of the two side walls 5*a*, 5*b* and spaced a distance apart from one another. The continuous recesses 9 run at an inclination from the outer chamfered side edges 5*c* and/or side surfaces obliquely downward in the direction of the crank 7 and emerge from the side walls in the lower area of the side walls 5*a*, 5*b*. The longitudinal axes 9*a* of the continuous recesses 9 may have an inclination with respect to the horizontal from an angular range of preferably 20° to 70°, especially preferably from 40° to 50°. To avoid having to explicitly enumerate each angular size within these ranges, only the limit values of the ranges are given. However, the applicant is herewith disclosing any angle size covered by the limit values of the range as being a favorable embodiment in conjunction with the present invention. All the continuous recesses 9, namely five on each side, have an inclination of 45° in the exemplary embodiment. Each of the continuous recesses 9 has sections with different diameters such that the upper section 9*b* having the larger diameter is followed by a lower section 9*c* having a smaller diameter by comparison.

In the area of the keel receptacle 5, which borders the crank 7, through-holes 11 are introduced in the bordering area and cooperate with the pegs on the fin device to be explained in greater detail below.

As FIG. 3 also shows, in the preferred embodiment of the keel receptacle 5 shown here, it is not connected directly to the ship's hull but instead is connected only via additional longitudinal bulkheads 3 and a crank plate 6 underneath them connected to the ship's hull. This imparts additional stability to the receptacle. The fastening of the keel receptacle here may also be accomplished in a form-fitting manner to the hull and/or optionally with the insertion of gusset plates 12 attached to the longitudinal bulkheads 3.

Figure 4:
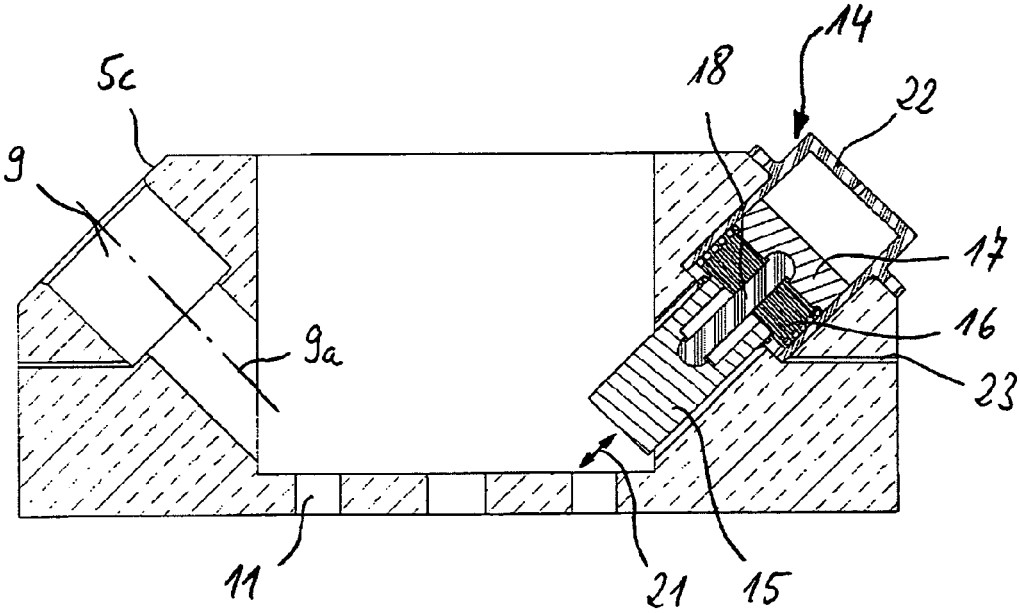
FIG. 4 is a cross sectional view of the keel receptacle from FIG. 3 together with part of a locking device.

The keel receptacle 5 is provided with a locking device having a plurality of bolt devices 14 designed in the same way, each of which is arranged in one of the continuous recesses. The bolt device 14 only one of which is shown in FIGS. 1 and 4 has a locking bolt 15 made of solid material, a resilient (elastic) element 16, a piston 17, two or more ring-shaped gaskets and a deformation element 18, which also functions as a piston rod. The latter is designed so that impact of a defined size can be absorbed while at the same time a prestress is exerted on the fin head plate 20 (FIG. 6) to center it in the keel receptacle 5 and support it without play. The piston rod 18 should preferably be able to transfer only forces in the axial direction in order to prevent tilting of the piston 17. To do so, the locking bolts 15 may be connected to the piston 17 with the addition of one or more hinges. The locking bolt 15 has a displacement path 21 in the cylinder running along the longitudinal axis 9*a* of the cylinder. The displacement path 21 of the locking bolt 15 thus has the same inclination with respect to the vertical or the horizontal which also characterizes the longitudinal axis 9*a* of the respective continuous recess 9. The cylinder is preferably designed as a single action cylinder. The reserve movement of the piston 17 takes place through the resilient element 16 while the forward movement preferably takes place due to the pressure of a fluid. The cylinder integrated into the keel receptacle 5 is sealed in a pressure-proof manner to a breech plate 22 which is detachably attached to the inclined side face 5*c*. The cylinder is also connected to a fluid supply, for example, a hydraulic oil supply so that a pressure acting on the piston 17 can be varied.

The locking device may also be provided with one or more detection units with which the positions of the locking bolts can be monitored. This may be used in particular to ascertain before a retraction movement of the fin device 2 whether the locking bolts 15 have been retracted and therefore there is no risk of a collision between the locking bolt 15 and the fin 4. If at least one bolt 15 has been pulled out, a control system (not shown in detail) cannot enable a traversing movement of the fin 4.

Figure 5:
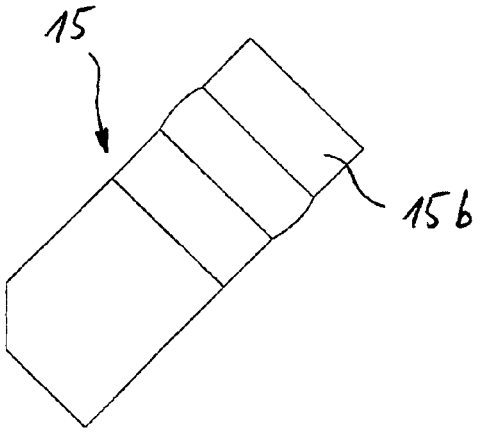
FIG. 5 is a view of one embodiment of a locking bolt.

Fluid that escapes past the fields can be drained out in a controlled manner by means of a drain 23. The locking bolt 15 is provided to press on the fin head plate 20, which is described in greater detail below, to lock it and secure it in the extracted state of the movable fin device 2, which can also be referred to as a retractable keel. To do so, the respective locking bolt 15 may have a partially chamfered end piece by means of which short lifting paths and surface contact of the locking bolt 15 with the fin head plate 20 may result, as is the case with the alternative preferred embodiment of a locking bolt 15 shown in FIG. 5. The locking bolt is designed here as a round cylinder of solid material and is provided with two ring-shaped seals on a deformation element 15*b* on its end opposite the chamfered end piece. The deformation element 15*b* is designed so that impacts of a defined size can be absorbed, while at the same time a prestress is exerted on the fin head plate 20 to center it in the keel receptacle 5 and support it without play. The flattening is performed so that it results in an end face 15*c* in the upper area of the transition from the end of the locking bolt 15 to its circumferential surface (this area being at the top with respect to the diagram in FIG. 5) such that this end face runs at least approximately parallel to the internal side face of the side wall 5*a*, 5*b* of the keel receptacle 5, from which the continuous recess emerges and in which the locking bolt 15 is arranged. In other embodiments, chamfered edges may also be provided by means of which the resulting partial face of the end face does not run parallel to the side wall of the keel receptacle.

Figure 10:
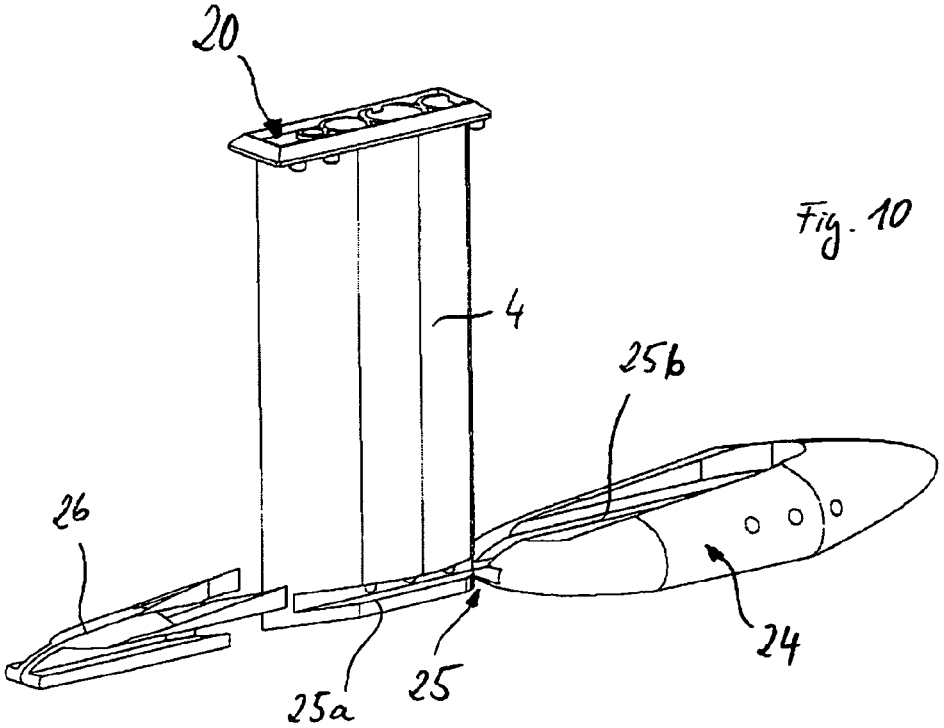
FIG. 10 is an exploded diagrammatic view of a preferred embodiment of a fin device according to the invention.
Figure 11:
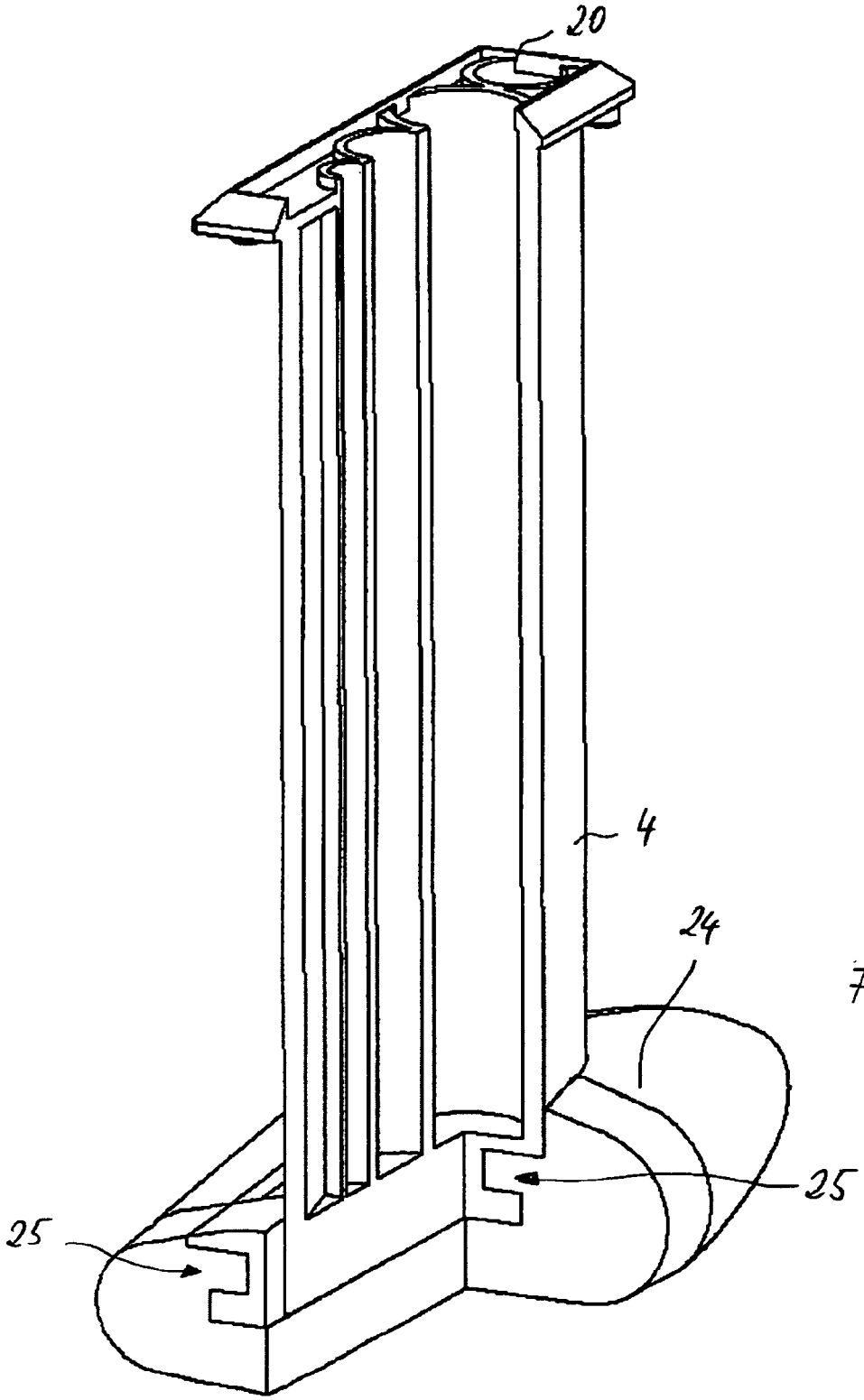
FIG. 11 is a partially cut-away diagrammatic view of the fin device from FIG. 10.

Finally, the retractable keel apparatus 1 has the fin 4 shown in FIGS. 1 and 2 which have an essentially known cross-sectional shape on whose lower end a ballast body 24 is attached. On its upper end the fin develops into the fin head plate 20. The ballast body 24, the fin 4 and the fin head plate 20 thus form a structural unit. The ballast body 24 may be pushed onto the lower end of the fin 4 in a form-fitting manner and then carried by that end. The fin and the ballast body may therefore be provided with a profiled guide 25, for example, with a guide having a T-shaped cross section as shown in FIGS. 10 and 11. The fin 4 here is inserted with its guide part 25*a* into the guide part 25*b* of the ballast body. By means of a form-fitting stop on the end of the guide part 25*b* the position of the fin on the ballast body 24 is predetermined. Since the fin 4 pushed onto the end does not completely fill up the guide of the ballast body 24, an additional ballast body part 26 is inserted into the guide part 25*b* behind the fin 4. In addition, the ballast body part 26 may supplement the ballast body 24 to the extent that both of them together have the external shape desired for the ballast body. Retaining bolts which may be provided as additional fastening for the ballast body on the fin 4 make it possible to additionally secure the ballast body and to absorb additional retaining forces. Preferably however the greater portion of the retaining forces should be borne by the aforementioned form-fitting connection.

Figure 6:
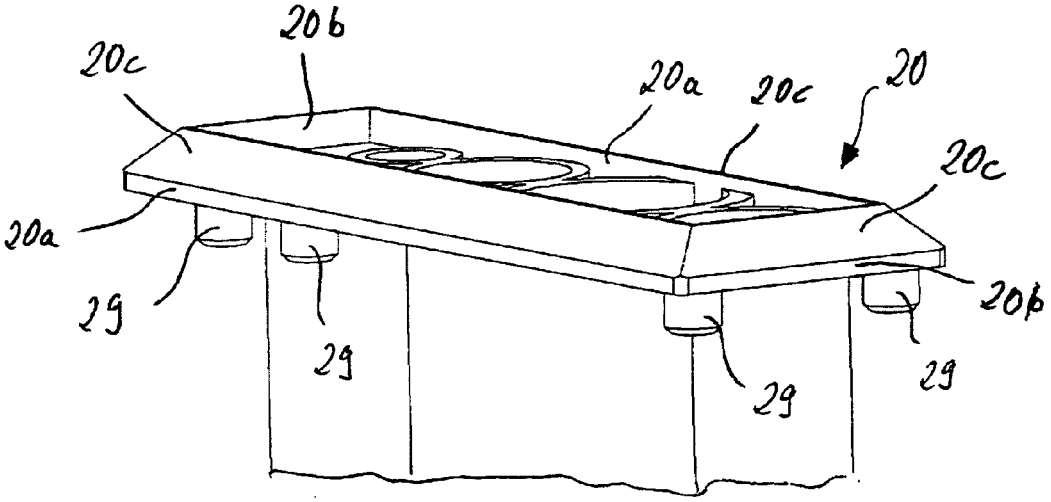
FIG. 6 is a view of a fin head plate of the retractable keel apparatus from FIG. 1.

The preferred embodiment of a fin head plate 20 shown in FIG. 6 has an approximately rectangular outer shape which is formed by the side walls 20*a*, 20*b* of the fin head plate 20. The side wall 20*a* of the fin head plate running in the longitudinal direction of the ship's hull have chamfered side faces 20*c* which are inclined from inward to outward in their upper outer areas. Pegs 29, which are provided with the fin 4 lowered for arrangement in the through-holes 11 of keel receptacle 5 with an accurate fit, are disposed on the bottom side of the fin head plate 20. The pegs 29 are of a length which is preferably greater than the length of the through-holes 11 of the keel receptacle 5 so that any dirt entering the through-holes 11 with the water is forced out of the boreholes.

FIG. 1 also shows a rectangular keel box 30 which is arranged above the keel receptacle 5 and has a keel box cover plate 31. The keel box 30 is attached to the underside of a deck 32 of the ship's hull with the keel box cover plate 31. Within the keel box 30 there is a lift device 33 which may be designed as a hydraulic lift cylinder, for example. The lift cylinder may be supported here on the underside of the deck 32 of the ship, for example, so that the piston of the lift cylinder is connected to the fin in a manner not shown in detail in order to move the fin 4 and the ballast body 24 out of the hull or into the hull. As shown in FIG. 2, for example, two guide blocks 34 are each connected to the fin head plate 20 and are in contact at the surface with their side faces and serve to and/or as a guide for the fin 4 on the keel box 30 in lifting movements of the fin 4. The guide blocks are each provided with recesses into which guide pegs 35 of the keel box cover plate 31 engage in the upper end position of the fin device 2 and thereby secure a predefined end position of the fin device. Furthermore, the guide pegs 35 engaging in the guide block 34 may serve as a form-fitting securing means for a crash incident in the retracted state of the fin device.

Figure 7:
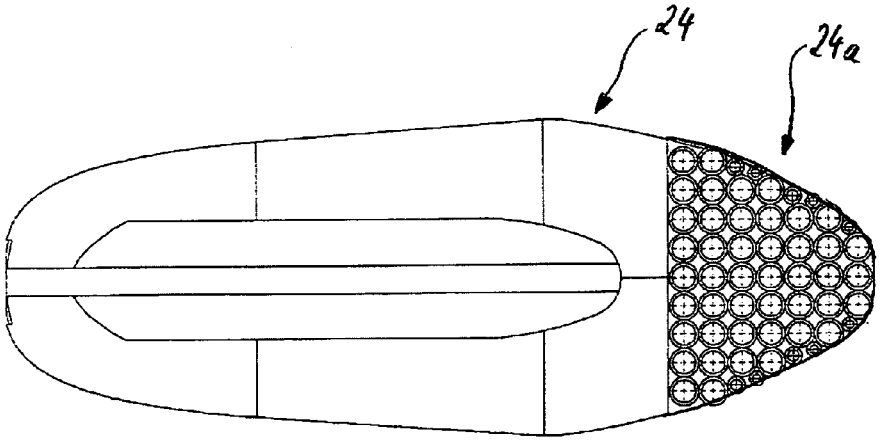
FIG. 7 is a view of a preferred embodiment of a ballast body.

FIG. 7 shows in wholly schematic form a preferred embodiment of the ballast body 24. The front area is designed as a deformation zone, which may also be referred to as a collapsible zone 24*a*. This has the advantage that in the event of a crash, at least some of the crash energy can be absorbed by the ballast body. The collapsible zone may be designed, for example, with a structure having a predetermined plastic deformability in the event of a crash. The deformation zone or collapsible zone is thus more readily deformable than that part of the ballast body, which follows it in the direction of travel.

Figure 8A:
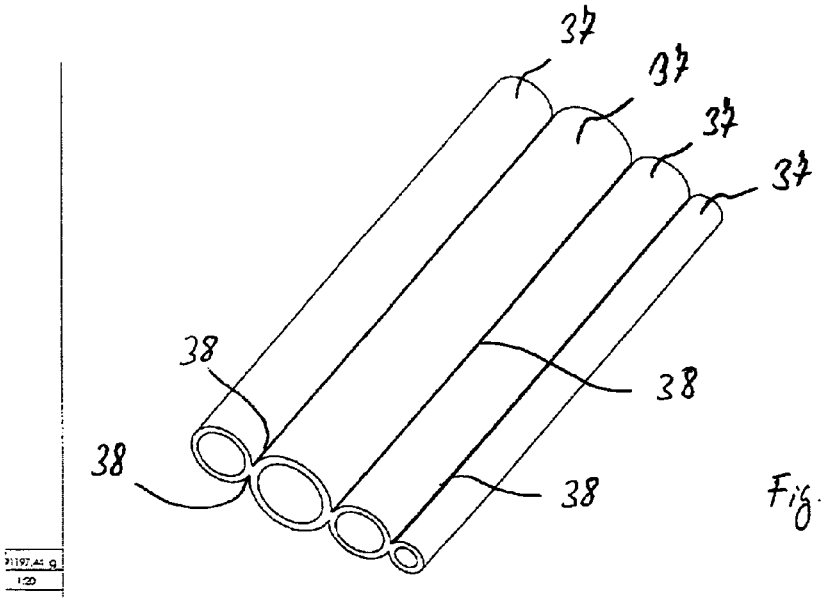
FIG. 8*a* is a view of one embodiment of a load-bearing structure for a fin.
Figure 8B:
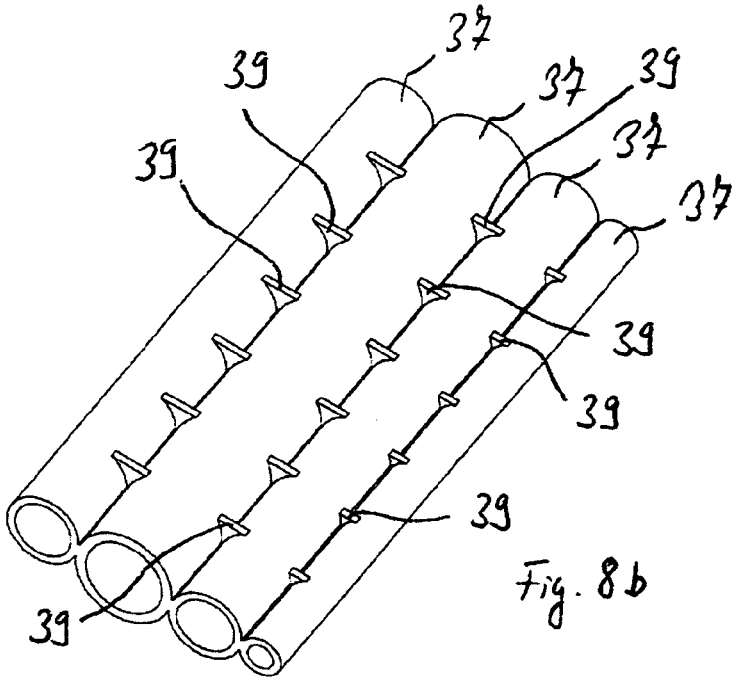
FIG. 8*b* is a view of another embodiment of a load-bearing structure for a fin.
Figure 8C:
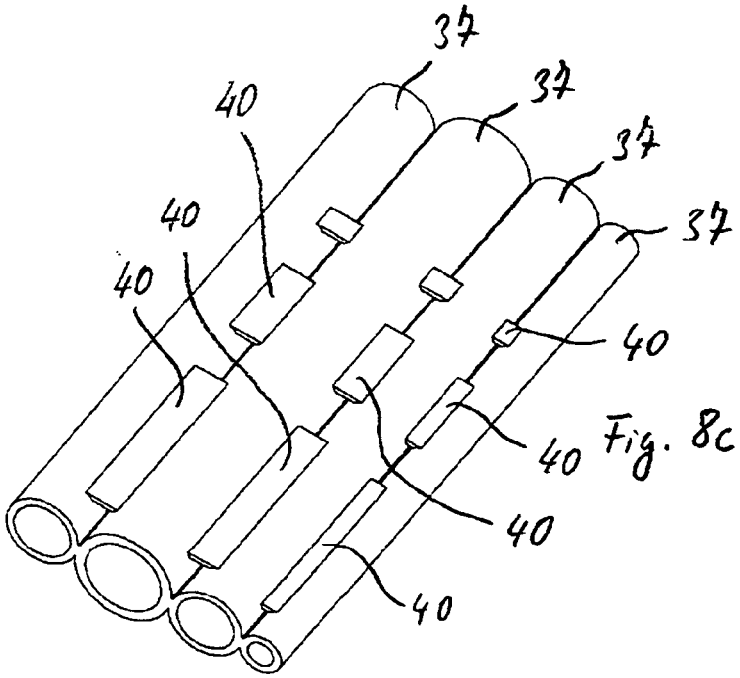
FIG. 8*c* is a view of yet another embodiment of a load-bearing structure for a fin.

FIGS. 8*a*, 8*b*, 8*c* show preferred embodiments of structures of the fin 4 according to the invention, where elongated profiles having predetermined cross-sectional shapes such as, for example, pipes, T, I or other profile shapes are arranged in the interior of the fin, oriented in parallel to one another and connected to one another. The profiles may be in particular extruded, pressed, rolled or extruded. The profiles are preferably aligned in rows and adjacent profiles are opposite one another. The profiles are oriented here with their longitudinal axis preferably at least approximately parallel to the longitudinal extent of the fin, as shown in FIG. 2. It is possible to use profiles having different cross-sectional shapes as well as those having the same cross-sectional shapes in order to form the load-bearing structure for a fin. It is expedient here to adopt the cross-sectional size of the profiles used to the respective width of the fin which the fin has at the location where the respective profile is used in the fin. Thus profiles with a larger cross section can be used at broader locations of the fin and profiles with a smaller cross section accordingly can be used at thinner locations in the fin.

The compounds may be embodied as welded connections. Pipes 37 as profiles may be joined to one another by means of longitudinal welds 38 running parallel to the longitudinal extent of the pipes according to FIG. 8*a*. Another possibility as shown in FIG. 8*b* is to arrange at least one knee plate 39, preferably at least one on each of the two sides of the pipes 37 and to arrange them between the two pipes 37 and to connect the one or more knee plates 39 to each of the pipes by means of welds. The pipes 37 here are thus connected to one another via the knee plates 39. In a third example (FIG. 8*c*) longitudinal plates 40 running parallel to the pipes 37 may be welded to the pipes 37 for a connection of the pipes 37 or other profiles.

Starting from a fin 4 that has been retracted into the keel box 30, this fin can be lowered out of the ship's hull by actuation of the lift device 33. In the final position after being lowered, the fin head plate 20 is inside the keel receptacle 5. The pegs 29 of the fin head plate 20 are arranged here in the through-holes 11 in the keel receptacle 5. In actuation of the locking device, all the locking bolts 15 are guided with their lower ends out of the continuous recesses 9 by the cylinders and pistons 17, preferably simultaneously, so they press on the inclined surfaces 20*c* of the fin head plate 20. In this way the fin head plate 20—and thus the fin 4 and the ballast body 24—are secured and held in this end position. The force required to lock the fin head plate and/or the fin 4 and the ballast body 24 is thus distributed among multiple locking bolts 15 and therefore the risk of complete failure of the locking device is minimized.

Due to the use of the keel receptacle 5 and the inclined arrangement of the locking bolts 15 and the inclined arrangement of the boundary faces 20*c* of the fin head plate 20, it is not necessary to over-dimension either the lift device, which is preferably embodied as a hydraulic cylinder, or the arrangement of lateral guide rails, which is often provided in the prior art, need not be over-dimensioned in order to absorb the forces occurring in a crash. This permits a simpler and more cost-efficient design. In addition, with this arrangement and embodiment it is especially advantageous that the locking bolts 15 cannot be sheared off as is the case with the horizontally positioned bolts known from the state of the art. Furthermore, the bolts 15 can absorb larger forces than the bolts arranged horizontally because the main forces act in the axial direction and not as shearing forces. This makes it possible to use bolts having a smaller diameter and thus bolts that are more favorable on the whole. Another advantage of this embodiment is that the keel can still be retracted even after a crash.

In the case of a crash, the predetermined deformable collapsible zone 24*a* of the ballast body 24 is deformed, whereupon some of the crash forces can already be absorbed here. Remaining and unabsorbed crash forces then lead to compression of the deformation element 15*b* of the locking bolts 15. If even greater forces occur, the bolts 15 are pushed back further due to the inclined arrangement of the locking bolts 15 and their contact surface with the fin head plate 20, and the complete keel (fin device) is thrown out of the receptacle. This prevents major damage to the keel, the receptacle and the ship's hull. In addition, it is preferable that the locking bolts 15 have chamfered end pieces so that the retractable keel can be unlocked with the shortest possible distance. Another advantage of this embodiment is that the locking mechanism can be repaired easily after a crash.

The inclined surfaces 20*c* of the fin head plate 20 may preferably also be used as a fit for secure support of the keel in the retracted state. The keel box cover plate 31 serves as a counter support here.

Alternative embodiments of the embodiments of the invention already mentioned above are described below. Identical reference numerals are used for elements that are functionally the same even if they are not structural identical. To avoid repetition, essentially the only differences in comparison with the embodiments already described will be mentioned in discussing the alternative embodiments.

Figure 12:
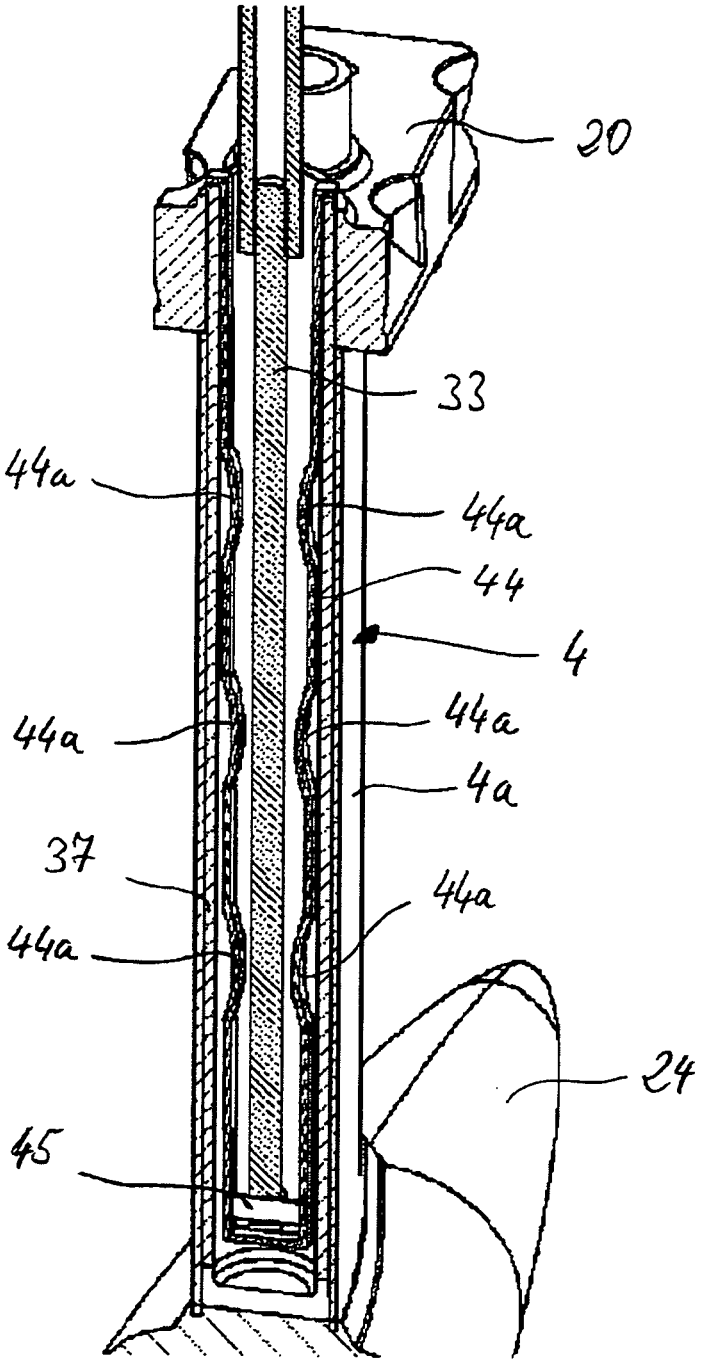
FIG. 12 is a section view of an alternative embodiment of the fin device from FIG. 11 with a deformation element integrated into the fin.

FIG. 12 shows another exemplary embodiment of the structural design of a fin 4 where the fin 4 is connected by a deformation element 44 to the lift device 33 such that according to FIG. 12 a preferred embodiment of the deformation element 44 may be designed as an insert into a fin 4. For the operative connection of the deformation element 44 to the lift device 33, the two may be connected to one another in the area of the lower end by means of a bolt 45. The deformation element 44 may be designed as a hollow body, for example. In the exemplary embodiment of FIG. 12, the deformation element has approximately a U shape with two legs running parallel to the lift direction of the lift device 33, these two legs being connected to one another via a connecting leg running crossways and situated in the area of the lower end of the fin. The geometric shape of the connecting element may also be described as a flat steel designed to be hollow on the inside, attached at its upper end to the fin head plate 20 of the fin 40, for example, by a welded connection. In this exemplary embodiment, the deformation element 44 is arranged inside one of the pipe profiles 37 through which the lift device 33 also runs. The deformation element is welded at its upper end to the pipe profile 37 and is otherwise arranged at a distance from the pipe profile 37 so that the pipe profile 37 does not interfere with deformation of the deformation element that may occur. The deformation element 44 also has multiple intended breaking points 44*a* distributed over its length, these points being designed, for example, as reductions in diameter and/or wall thickness. Impacts can be absorbed by the deformation element 44 in particular in the longitudinal direction of the fin 4 such that the deformation element 44 undergoes deformation in a predetermined manner because of overstress in essentially the longitudinal direction of the deformation element 44 to thereby absorb the crash energy. Due to this uptake of energy, the transfer of force from the fin 4 to the lift device 33 may be interrupted or at least diminished and possible damage to the lift device 33 and additional components of the ship may be prevented.

Figure 13:
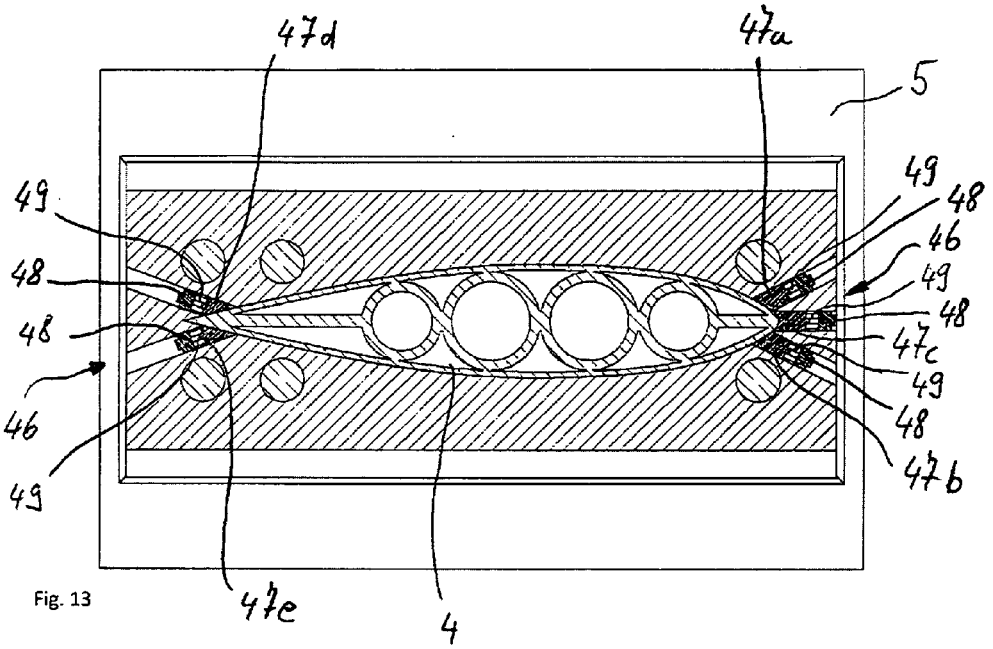
FIG. 13 is a cross-sectional view of a guide for the fin.

FIG. 13 shows an alternative embodiment of a fin guide 46 where the fin 4 is entered via fin guide 46 in the keel receptacle 5 mounted to the side of the fin. Due to the central guide, the striking of fin 4 against the keel receptacle 5 and the resulting damage to components of the retractable keel, which occurs with the retractable keel apparatuses known in the past, can be prevented. In a preferred embodiment of the fin guide 46, the guide may be integrated into the keel receptacle 5.

FIG. 13 shows a plurality of guide element designed as guide bolts 47, each of which is in contact with the fin 4 with a prestress spring element 49 and is pressed against it. With respect to the cross section through the keel receptacle 5 and the fin 4 shown in FIG. 13, there are guide bolts 47 in recesses in the keel receptacle 5 in the area of the two end sides of the fin 4 such that two guide bolts 47*a*, 47*b* are arranged on each side of the fin on the front end face of the fin 4—i.e., the end pointing in the direction of travel, and centrally with these a third guide bolt 47*c* is arranged such that the central guide bolt 47*c* is aligned with the longitudinal axis of the cross section through the fin 4. In the area of the rear end face of the fin 4—at the rear with respect to the direction of travel—a guide bolt 47*d*, 47*e* is arranged on each side of the fin 4 symmetrically with the longitudinal axis of the fin 4. The prestressing force on each spring element 49 can be adjusted by means of a prestressing nut 48 such that the prestressing force is increased by turning the prestressing nut in the direction of the fin 4. With such an approach, it is possible to achieve an inexpensive and nevertheless very accurate guidance in which tilting of the fin 4 can be largely prevented. Centering of the fin with respect to a predetermined setpoint longitudinal axis of the fin can be performed by means of the adjustable guide element.

Figure 14:
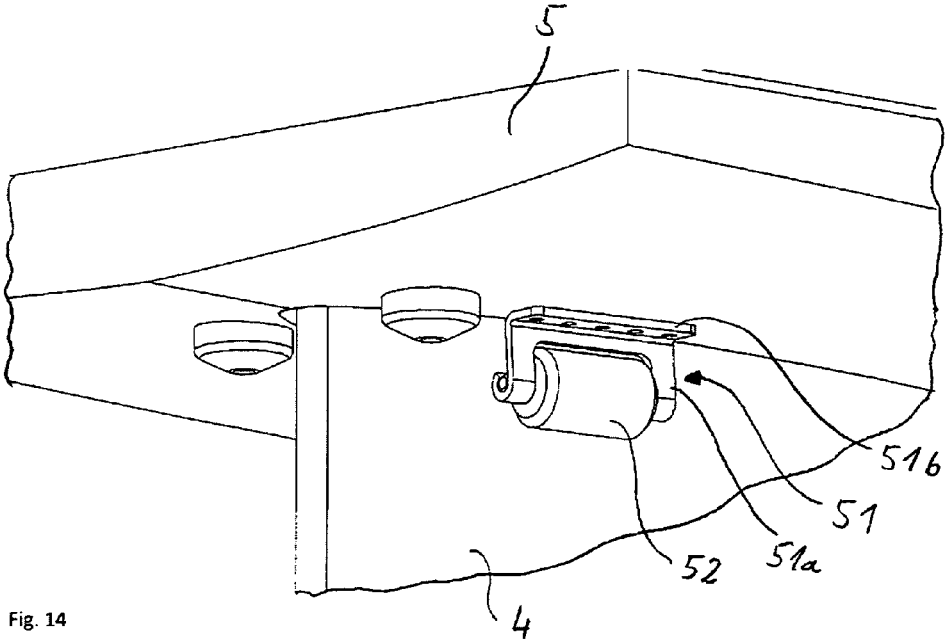
FIG. 14 is a view of another exemplary embodiment of a guide for a fin.

In another preferred embodiment, the guide may be arranged beneath the keel receptacle 5. To this end multiple rolls 52 may be provided, these rolls being in contact with the fin 4 under a prestressing force. As indicated in FIG. 14, each of the rolls 52 may therefore be accommodated by a bending holder 51 such that the roll 52 is rotatably mounted on a holding leg 51*a* of the bending holder 51. The holding leg 51*a* is connected here in one piece to a fastening leg 51*b* of the bending holder 51 which is angled by approx. 90° with respect to the holding leg and can be deflected elastically with respect to the fastening leg 51*b*. The angle formed by the fastening leg 51*b* and the holding leg 51*a* may be variable as a function of the desired prestressing force. The bending holder 51 is mounted on the underside of the keel receptacle 5 by the fastening leg 51*b*, for example, by using fastening elements such as screws or rivets. In other embodiments the bending holder 51 and the keel receptacle 5 may also form a unit where the bending holder 51 is entirely or partially connected in one piece to the keel receptacle 5. These embodiments have the advantage that repairs and maintenance work can be performed without any great effort due to the good accessibility.

Figure 15:
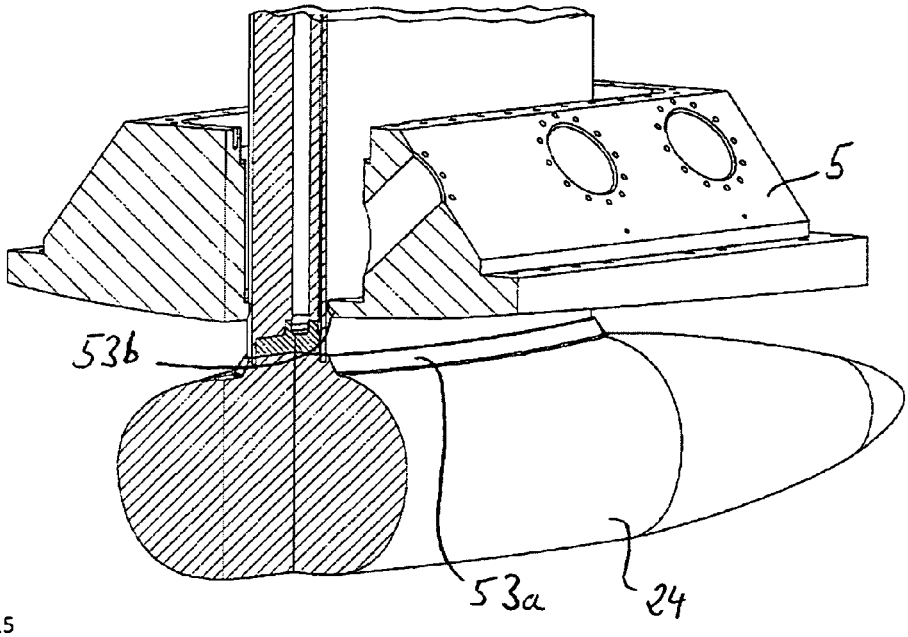
FIG. 15 is a partial sectional view of an embodiment of the retractable keel apparatus in which a form-fitting connection between the ballast body and the keel receptacle can be created with the retracted fin.

FIG. 15 shows an alternative embodiment which brings advantages in particular in dry docking of the ship. Thus in this embodiment, the ballast body 24 and the keel receptacle 5 are designed so that in dry docking the keel receptacle 5 sits in a form-fitting manner on the ballast body 24. As shown in FIG. 15, this may be accomplished, for example, by the fact that the ballast body 24 has an attachment 53, which is designed with an inclined face and comes into surface contact with a corresponding negative shape 53 of the keel receptacle 5. In this way, the weight of the ship from the ballast body 24 presses directly on the keel receptacle 5 which is in surface contact with the ballast body 24, thereby introducing stresses into the keel receptacle 5 and from there into the hull of the ship. In the approaches known in the past, the ship usually is also supported on the ballast body in dry docking by means of which the gravitational force then acts on the lift device and is introduced from there into the deck. In this way, there may already be damage to the lift device and/or the deck, which can be prevented by the preferred embodiment according to the invention. Since the keel receptacle 5 is preferably connected to the entire ship structure, in the preferred embodiment according to the invention the stresses are also introduced into the entire ship structure and absorbed there. This embodiment also brings the additional advantage that the fin device 2 can be supported without play when the fin device 2 is retracted and anchored while in water. Since the ballast body 24 is in form-fitting contact with the lower outer keel receptacle 5 because of its shape and the shape of the keel receptacle 5 in this contact, any impacts of the ballast body 24 against the keel receptacle can be prevented along with the associated risk of damage to the keel receptacle. To relieve the burden on the lift device and the hydraulic system, it is possible to provide that the retracted fin can be secured by means of a lift device, preferably a hand wheel.

Figure 16:
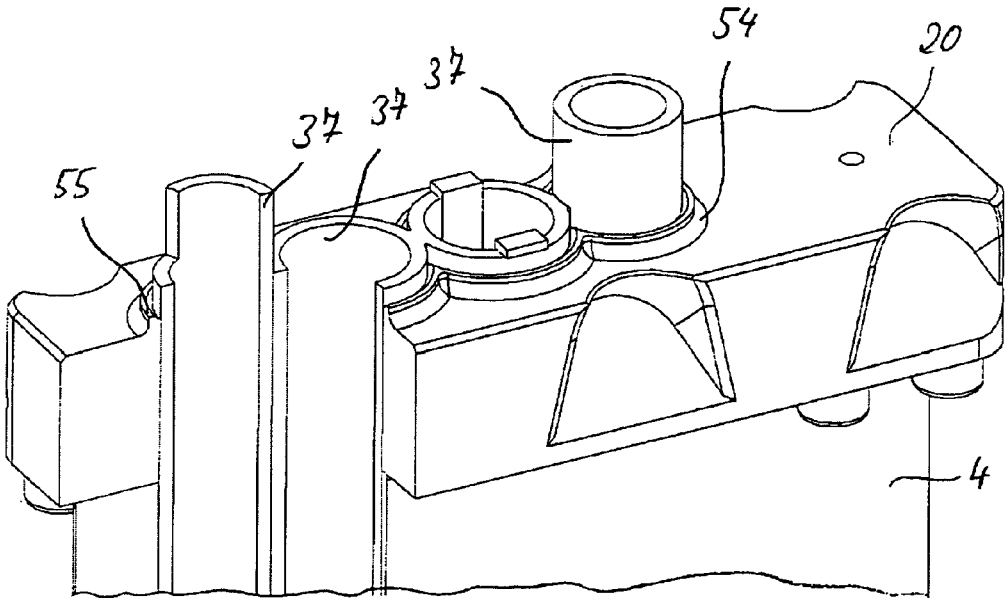
FIG. 16 is a view of an embodiment of the fin head plate with a welding collar.

FIG. 16 shows a preferred embodiment of the fin head plate 20 which heater has a welded collar 54 protruding upward out of the top side of the fin head plate, its geometric shape corresponding approximately to the cross section of the profiles 37 used within the fin 4. The welding collar 54 should prevent excessive dissipation of heat in welding the profiles 37 to the fin head plate 20 and therefore is designed as an elevation in the material protruding away from the top side of the fin head plate 20. The welding collar preferably has a welding chamfer 55 created on it to prepare for the weld.

Figure 17:
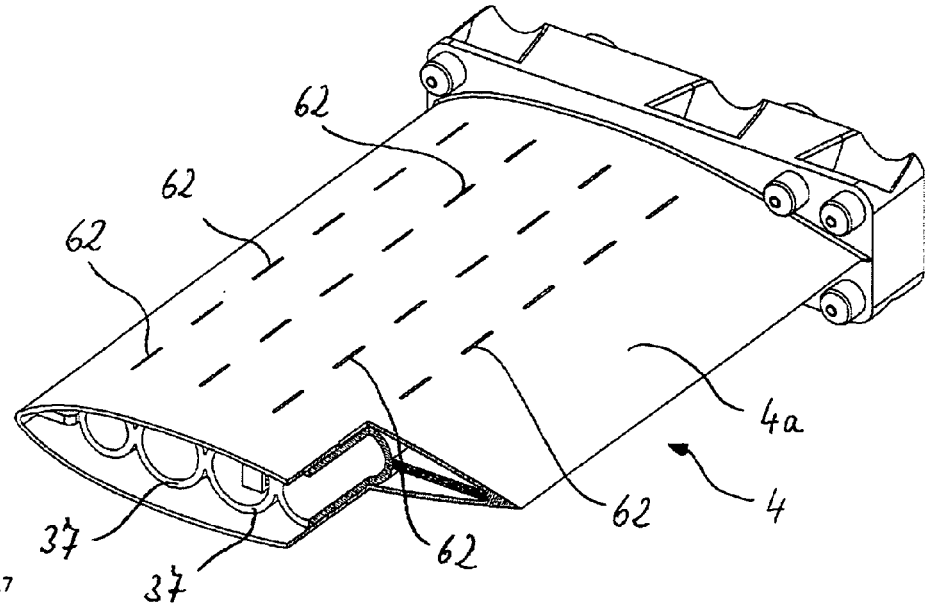
FIG. 17 is a view of the fin with planking, which is provided with welding aids.

To facilitate welding of the planking of the fin 4 with profiles 37 that are situated within the planking and impart stability to the fin 4, the planking may be provided with the elongated shapes 62 on the outside, as shown in FIG. 17, which may be used for welding. Individual shapes 62 may be arranged here in dash-dot lines one after the other and parallel to the respective longitudinal axis of the tube profile 37 for whose welding to the planking 4*a* it is provided. The shapes 62 are advantageously situated here at the locations on the outside of the planking 4*a*, where the profiles 37 are in contact with the inside of the planking 4*a*. Due to the shapes 62 the creation of the welds can be facilitated on the one hand because the shapes 62 serve as an orientation for the locations where the welding is to be performed. Furthermore, the shapes 62 which are designed as collections of material help to dissipate excessive expansion due to heat and thus also prevent heat distortion in the planking 4*a*.

Figure 18:
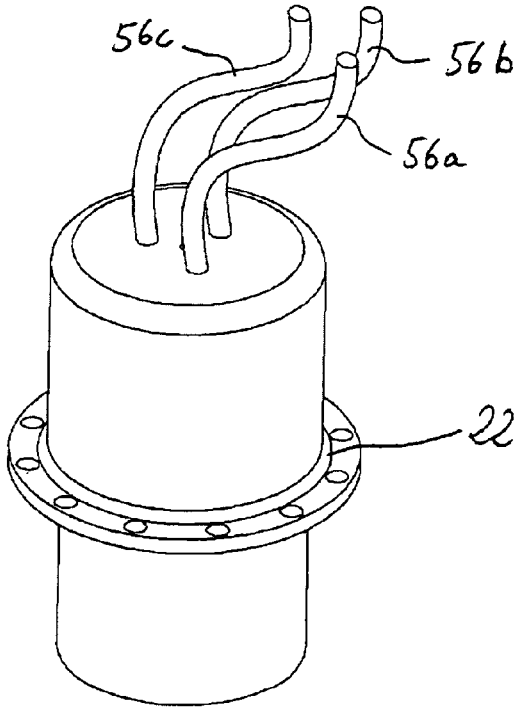
FIG. 18 is a view of a preferred embodiment of a breech plate of the bolt device.

FIG. 18 shows a preferred embodiment of the breech plate 22 of the bolt device 14 from FIG. 4 which has three connections 56*a*, 56*b*, 56*c* by which the pressure medium can be supplied or removed from moving and positioning the piston of the bolt device 14. One of the three connections 56*a*, 56*b*, 56*c* is provided for the control operation. The respective bolt device 14 is supplied with a fluid through this connection 56*a* such that the fluid is preferably pumped with a mechanically drive pump not shown in detail in the figures. One other of the three connections then serves to construct a redundant system, where this connection 56*b* is supplied with a fluid which is then pumped by means of a hand pump.

To be able to rule out overstressing of the entire retractable keel apparatus 1 due to an existing lock in conjunction with a crash, another connection 56*c* is provided on the breech plate 22. This connection 56*c* has an excess pressure unit which allows the fluid in the bolt device 14 to flow out of the bolt device when a preset pressure is exceeded. Because of the outflow of the fluid, the locking bolt 15 shown in FIG. 4 can be forced back further and the fin (fin device) is thrown out from the keel receptacle.

Figure 19:
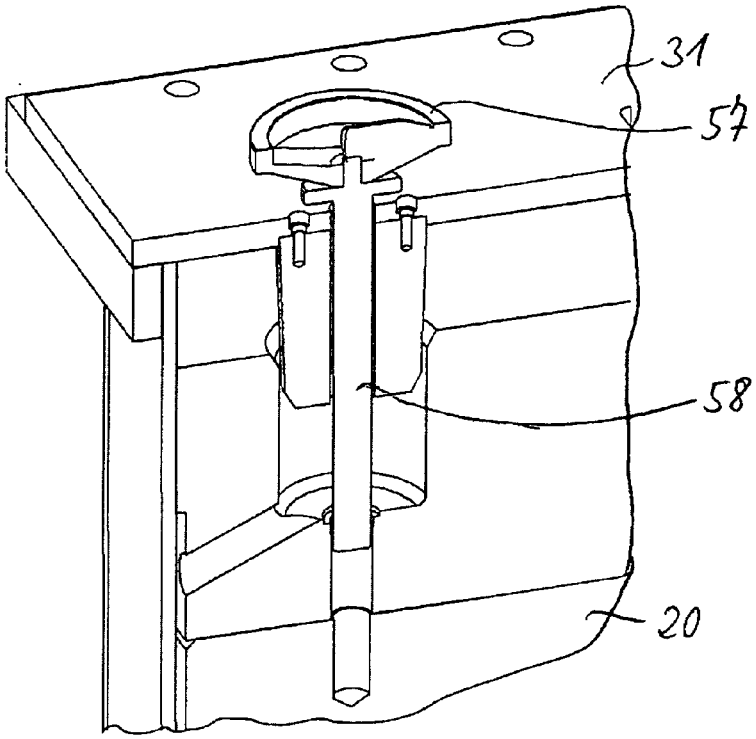
FIG. 19 is a view of a preferred embodiment of a fin head plate that can be secured in its position.

The preferred approach shown in FIG. 19 offers the advantage that a ship need not be dry docked for maintenance and repair work on the retractable keel apparatus 1, as was necessary in the past. To do so the fin head plate 20 is secured in the retracted state of the retractable keel apparatus. A preferred option for this can be provided by a hand wheel 57, with which a threaded spindle 68 that which is screwed from above into an inside thread in the fin head plate 20 and is driven by the keel box cover plate 31. Thus the fin can be retracted into the hull using the hand wheel 57 even if the ship is in water. Furthermore, by securing the fin head plate 20, the load on the lift device 33 is released. Finally, this provides an opportunity to install the lift device 33 to be extractable and retractable if necessary.

Figure 20:
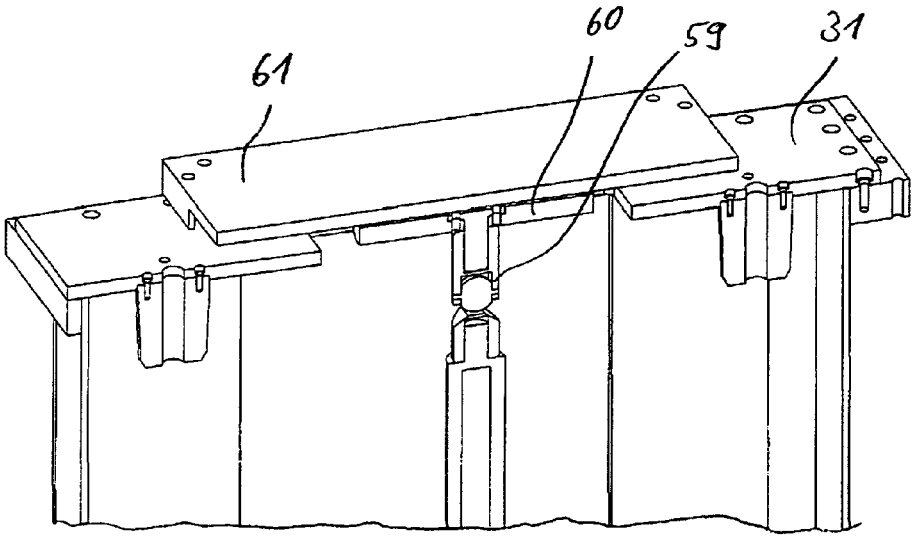
FIG. 20 is a view of a lift device, which is connected by a release to the fin.

Previously known lift devices are usually rigidly mounted on the deck and connected to the fin 4. Due to the rigid installation, an increase in force occurs in a crash or in a normal deflection of the keel, and can lead to damage to the retractable keel apparatus 1. To achieve an improvement here, in a preferred embodiment of the invention as shown in FIG. 20, the lift device 33 can be connected to a slip element 60 via a cardan joint 59 so that a loose bearing seating (loose bearing) can be produced. In the process of lifting the fin 4, the slip element 60 sits on the keel box cover plate 31. In the event of an unintentional movement of the fin 4 in the direction of the deck, caused by a crash, for example, the slip element 60 is limited by a stop element 61 which sits above the slip element 60. The slip element 60 is deflected by the exemplary embodiment 61, and the fin 4 can then move freely in the direction of the deck.

Figure 21:
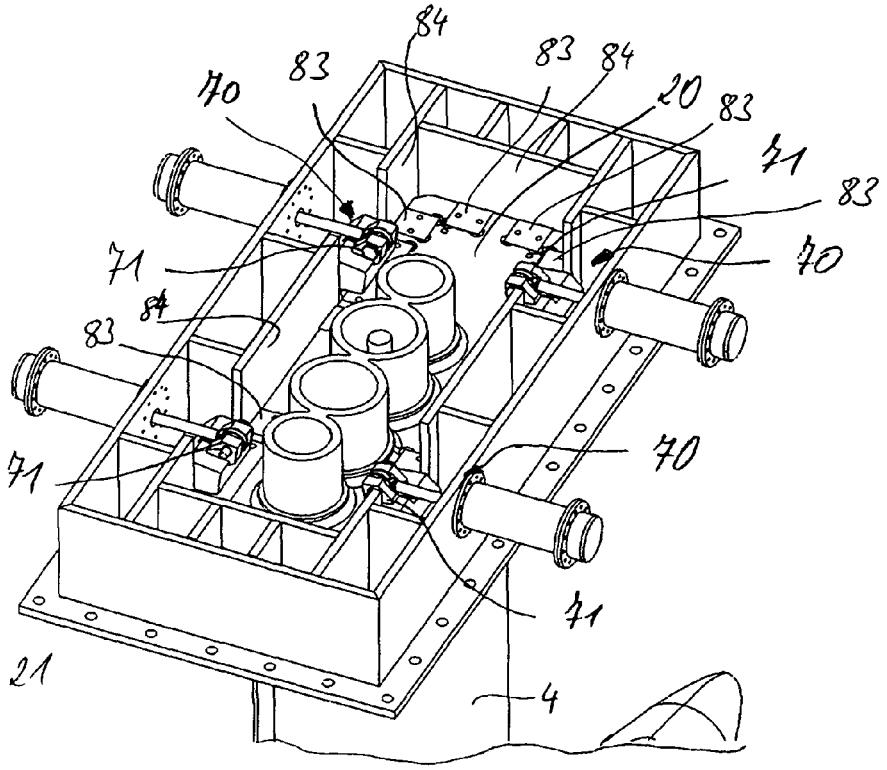
FIG. 21 is a view of another embodiment of a locking device.

Finally, FIG. 21 shows another embodiment according to the invention which differs from the embodiment shown in FIG. 1 and FIGS. 3-6 in particular with regard to the locking device. Instead of locking bolts, pivotable locking bars 71 of a locking device 70 are provided here; the fin head plate 20 can be gripped and locked with them. The four locking devices 70 are identical in design. In the exemplary embodiment in FIG. 21, a total of four locking bolts 71 are provided, each of which is in one of the corner areas of the fin head plate.

Figure 22:
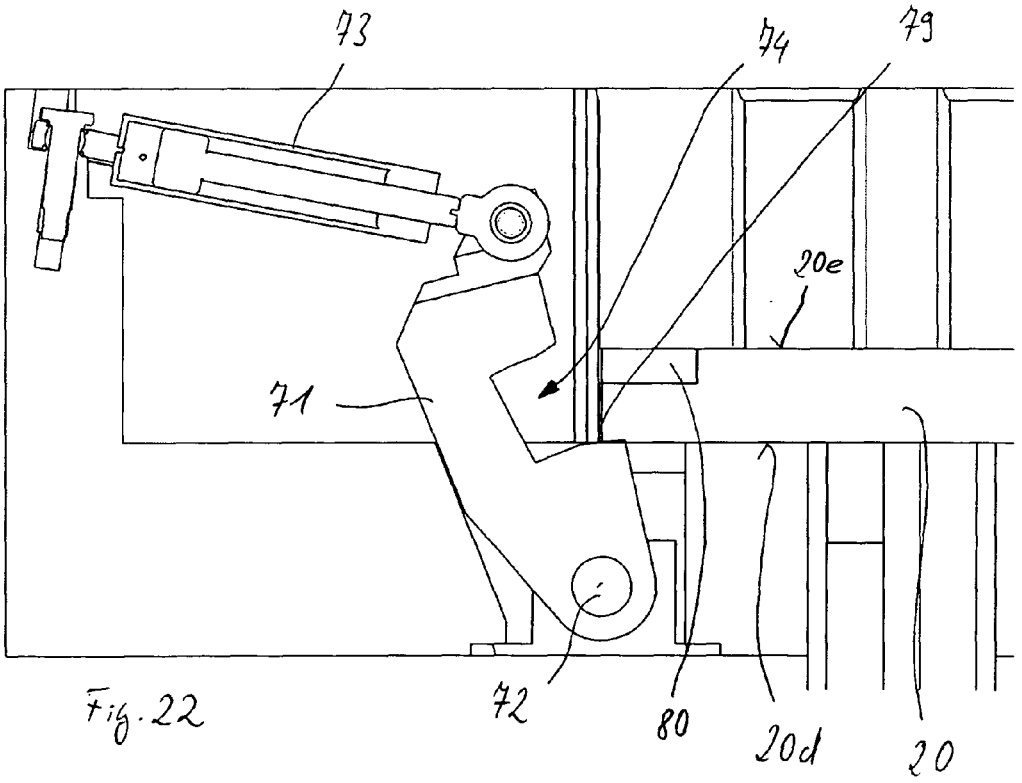
FIG. 22 is a view of the locking device of FIG. 21 in a release position.

As shown in FIG. 22 in particular, the locking bars are pivotable about a lower pivot axis aligned approximately horizontally, this pivot axis being the result of a horizontally aligned axis 72 on which the locking bars are each arranged with a friction bearing.

The locking bars 71 that are hinged connected on their upper ends are each connected to a hydraulic cylinder 73 that is capable of exerting both compressive forces and tensile forces on the locking bar, so as to be able to pivot the respective locking bar 71 both clockwise and counterclockwise. The hydraulic cylinders are arranged on a keel receptacle 5, which is designed as a keel module 75, with their end facing away from the locking bar 71 and they are supported on this keel receptacle. The locking bars 71 are thus rotated abut the pivot axis about a lever which results due to the distance of the respective hinge point of the hydraulic cylinders 73 on the locking bars 71 from the respective pivot axis. The locking bars can thus be moved into two end positions by driven movements, namely into the release position shown in FIG. 22 and into the locked position shown in FIGS. 23 and 24. In the former position, the respective locking bar releases the fin head plate 20, while in the locked position an edge area of the fin head plate 20 is arranged in a groove-type recess 74 on the respective locking bar 71, so the locking bar 71 thus comprises the fin head plate 20 of the fin device with the groove-shaped recess 74, the fin device being in the extracted and thus lowered position here. In the locking position, the hinge point of the hydraulic cylinder should be guided beyond the vertical with respect to a vertical running through the pivot axis so that the fastening of the hydraulic cylinder 73 on the keel module 75 and the hinge point is located on different sides of the respective vertical.

Figure 25:
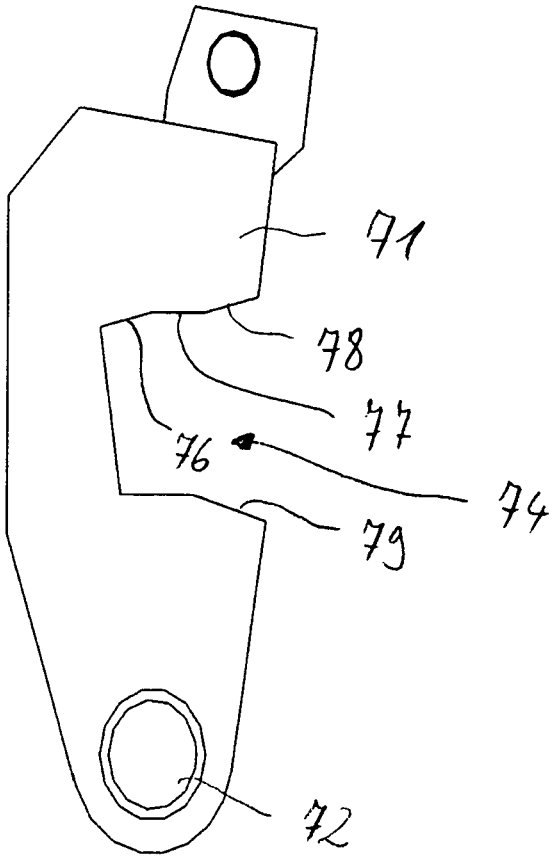
FIG. 25 is a view of a locking bar of the locking device of FIG. 21.

As shown in the diagram of one of the locking bars 71 in FIG. 25, its groove-shaped recess 75 has an upper bordering surface which is formed by a series of three partial surfaces arranged one after the other. Starting from the base of the groove toward the open side of the recess 74, this is an equalizing surface 76 to which is connected a bearing surface 77 and a collecting surface 78 connected to the latter. The collecting surface 78 is inclined upward so that the width of the opening of the recess 74 increases from the bearing surface 77 outward to the opening. The bearing surface 77 is aligned essentially horizontally in the locked position. The equalizing surface 76 is inclined downward starting from the bearing surface 77 so that the height of the groove-shaped recess 74 becomes smaller toward the base of the groove.

Opposite these surfaces 76, 77, 78, there is a lower bordering surface of the recess 74, which has an ejector surface 79 as part of the bordering surface in the opening area of the recess. The alignment of the ejector surface is such that it comes in contact with the underside of the fin head plate 20 in a pivoting opening movement of the locking bar toward the release position. The locking bar can only reach its release position when it lifts the fin head plate 20 slightly upward with its pivoting movement. This situation is depicted in FIG. 22. Since all the locking bars should be executing this movement at the same time, the fin head plate is raised simultaneously by all the locking bars 71 and is released from the form-fitting connection between the pegs and their recesses in this way.

Figure 23:
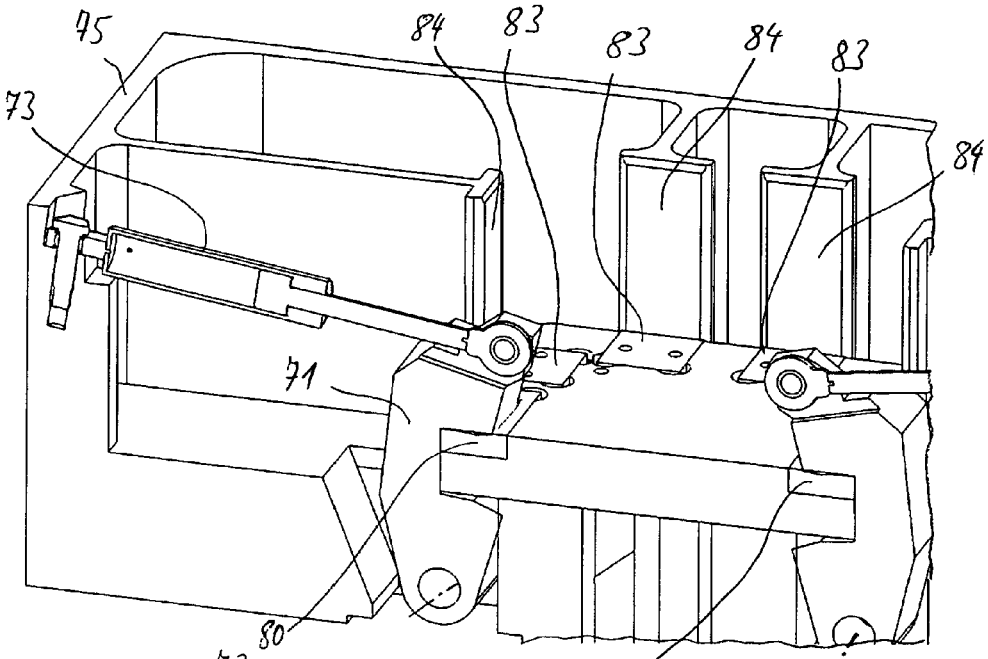
FIG. 23 is a view of the locking device of FIG. 21 in a locked position.
Figure 24:
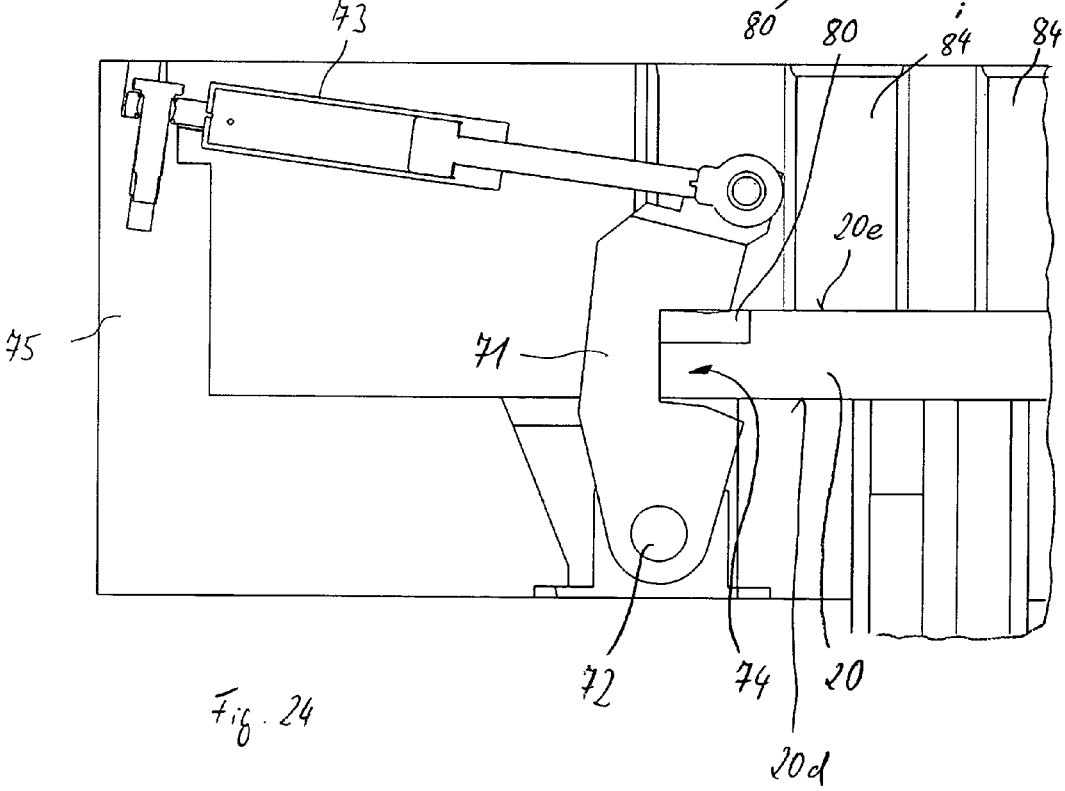
FIG. 24 is a view of the locking device of FIG. 21 in a locked position.

In the pivoting movement from the release position into the locked position shown in FIGS. 23 and 24, first the collecting surface 78 goes beyond the fin head plate 20. If the pin head plate is arranged too high, the inclination of the collecting surface with its top side 20*e* can nevertheless be detected, can enter the recess 74 and can easily be pressed downward. Then the bearing surface 77 comes in contact with the top side 20*e* of the fin head plate 20 and holds it down. With the equalizing surface 76, any play that might be present in particular between the locking bar 70 and the pin head plate 20 can be compensated by depressing it by means of the locking bar 70 and the fin head plate 20 can be held down despite the play.

As also shown in FIGS. 21-24, an equalizing plate 80 is inserted into the fin head plate in the areas of the top side 20*e* of the fin head plate 20 in which the latter comes into contact with one of the locking bars 71. As a result the bearing surface can be adapted individually for each locking bar 71. Supports can be compensated by replacing the equalizing plates. Pivoting locking bars 71 and equalizing plates 80 may thus be paired up optimally and adjusted in accordance with their task in the material used.

In contrast with traditional retractable keels, the guide rails used previously for guiding the fin device are not necessary with the approaches according to the invention. One possibility for secure guidance with the approaches according to the invention consists of guiding the fin device in the keel receptacle 5, in particular in the keel module 75 as shown in FIG. 21. One such guide can be provided by replaceable lateral friction bearings 83 on the fin head plate 20 which move on sliding surfaces 84 of the keel receptacle 5 and/or of the keel module 75. The fin 4 itself can be guided by the spring-supported pressure rollers mentioned above, so that scratching of the lacquer layer of the fin can be prevented. As soon as the fin is completely retracted, a form-fitting connection ensures in particular pegging 35 on the upper end of the keel box, in particular of the keel box cover plate with the fin device, in particular with the fin head plate 20, ensuring reliable support of the fin device without any play. This is true in particular when the ballast weight is in form-fitting connection with the underside of the ship's hull, preferably simultaneously on the other end of the fin device.

Form-Fitting Connection of the Ballast Weight/Fin with the Ship's Bottom

The lower end of the fin may be positioned and stabilized either via the pressure rollers or a form-fitting connection between the ballast weight and the keel module. This form-fitting connection also ensures that in dry docking of the boat, the weight of the boat is centered directly over the ballast weight instead of over the keel box and/or the deck and the ship's hull. If the ballast weight cannot be used entirely, depending on the lift and the draft selected, then the fin may be designed to be thicker in the lower part accordingly and may thus form the form-fitting connection with the ship's hull in retraction.)

Hydraulic Expressing Device

Because of the unfavorable leverage ratio, high forces may be necessary for releasing the form-fitting connection. Corrosion and choice of material also have an influence on these forces. To support the lift cylinder, corresponding hydraulic expression aids can now lift the fin head plate. In contrast with the lift cylinder, these require only a short distance.

High-Pressure Expressing Device

In addition, boreholes may be provided in the keel module to the form-fitting connection such that water, for example, is directed at a high pressure in between and thus the necessary expressing force is achieved. To prevent tilting of the pegging, there are preferably multiple circles so it is possible to select where and at what pressure the water is expressed. A force sensor can measure this tilt and control the individual circles.

Automatic Locking/Release of the Retractable Keel Cylinder for Maintenance

The retractable cylinder engages deeply in the fin, where it is difficult to install. Therefore, a device may be present for automatically installing it there and/or being able to release it for maintenance. To do so, a coupling jaw like that used for tractors and trailers is mounted in the fin or on the end of the lifting cylinder, this coupling jaw being automatically snapped in place when the lift cylinder is inserted into the fin. The release can be accomplished with the help of a mechanical device (rod, tension cable), an electromagnetic device (electromagnet) or a hydraulic device, which opens the coupling jaw lock as needed.

To absorb some of the resulting energy in a crash, the ballast weight maintains a collapsible zone in the tip (figure). This is deformed in impact and the braking acceleration is reduced, so that the forces introduced into the fin are also greatly reduced. This collapsible zone may have various designs (figure), for example, it may be made of a lined tube package that absorbs energy due to compression. Such plastic-lined packages prevent major damage to the boat structure and can be replaced easily in the event of damage. They are also suitable for fixed keels in principle.

The keel box module may also be provided with elements that can be predeformed in a defined manner to be able to absorb crash forces in the event of a crash even through this replaceable module. Furthermore, the keel box module may be provided as a standardized module that is used in various ship's hulls and thus permits an economical mass production of retractable keels. Different boat sizes may be covered here by a small number of keel box modules with different dimensions and their respective fin devices.

While specific embodiments of the invention have been shown and described in detail to illustrate the application of the principles of the invention, it will be understood that the invention may be embodied otherwise without departing from such principles.

LIST OF REFERENCE NUMERALS

| | |
|---|---|
| 1 | Retractable keel apparatus |
| 2 | Fin device |
| 3 | Longitudinal bulkhead |
| 4 | Fin |
| 4a | Planking |
| 5 | Keel receptacle |
| 5a | Side wall |
| 5b | Side wall |
| 5c | Upper chamfered side edge |
| 6 | Crank plate |
| 7 | Crank |
| 8 | Opening |
| 9 | Continuous recess |
| 9a | Longitudinal axis |
| 9b | Upper section |
| 9c | Lower section |
| 11 | Through-hole |
| 12 | Node plate |
| 14 | Bolt device |
| 15 | Locking bolt |
| 15b | Deformation element |
| 15c | Chamfered end face |
| 16 | Elastic element |
| 17 | Piston |
| 18 | Deformation element |
| 20 | Fin head plate |
| 20a | Side wall |
| 20b | Side wall |
| 20c | Inclined face |
| 20d | Bottom side |
| 20e | Top side |
| 21 | Displacement distance |
| 22 | Breech plate |
| 23 | Sequence |
| 24 | Ballast body |
| 24a | Collapsible zone |
| 25 | Profiled guide |

-continued

| | |
|---|---|
| 25a | Guide part |
| 25b | Guide part |
| 26 | Ballast body part |
| 29 | Pegs |
| 30 | Keel box |
| 31 | Keel box cover plate |
| 32 | Deck |
| 33 | Lift device |
| 34 | Guide block |
| 35 | Guide block |
| 37 | Pipe |
| 38 | Longitudinal weld |
| 39 | Knee plate |
| 40 | Longitudinal plate |
| 44 | Deformation element |
| 45 | Bolt |
| 46 | Fin guide |
| 47a-e | Guide bolt |
| 48 | Prestressing nut |
| 49 | Spring element |
| 51 | Bending holder |
| 51a | Holding leg |
| 51b | Fastening leg |
| 52 | Roll |
| 53a | Attachment |
| 53b | Negative mold |
| 54 | Welding collar |
| 55 | Welding chamfer |
| 56a-c | Connection |
| 57 | Hand wheel |
| 58 | Threaded spindle |
| 59 | Cardan joint |
| 60 | Slip element |
| 61 | Stop element |
| 62 | Shape |
| 70 | Locking device |
| 71 | Locking bar |
| 72 | Axis |
| 73 | Hydraulic cylinder |
| 74 | Groove-shaped recess |
| 75 | Keel module |
| 76 | Equalizing surface |
| 77 | Bearing surface |
| 78 | Collecting surface |
| 79 | Ejector surface |
| 80 | Equalizing plate |
| 83 | Friction bearing |
| 84 | Friction surface |

APPENDIX

The retractable keel apparatus, characterized in that the at least one locking bar is provided with a bearing surface with which the locking bar can be brought into contact with a to side of the fin head plate.

The retractable keel apparatus, characterized by a groove-shaped opening in the at least one locking bar in which an edge area of the fin head plate can be accommodated, in particular being accommodated in such a way that a bearing surface formed on the inside of the groove can be brought into contact with a top side of the fin head plate.

The retractable keel apparatus, characterized by at least one equalizing plate inserted into the fin head plate, provided for contact against the bearing surface of the at least one locking bar.

The retractable keel apparatus for a ship, in particular for a sailboat, having a lowerable and retractable fin device, which is provided with a fin and a ballast body arranged on the fin, characterized in that a connection is established between the fin and the ballast body as a form-fitting connection.

The retractable keel apparatus, characterized in that the locking bolts which are additionally provided for the form-fitting connection as the connection between the ballast body and the fin absorb only a portion of the connecting forces, preferably the smaller portion of the securing forces.

The retractable keel apparatus for a ship, in particular for a sailboat which has a lift device for a lowerable and retractable fin device, which is provided with a fin and an upper fin head plate arranged thereon and a lower ballast body, which comes into contact with a keel receptacle which is provided for permanent connection to the ship's hull when the fin is lowered in contact with a keel receptacle that is provided for permanent connection to a ship's hull, characterized by means for predetermined deformation in the event of a crash.

The retractable keel apparatus, characterized in that the ballast body is equipped with a collapsible zone in the front area.

The retractable keel apparatus, characterized in that the fin is connected to the lift device using a means for predetermined deformation such that the means is designed in particular as a hollow body having predetermined deformation sites.

A fin device for a retractable keel apparatus, equipped with a fin and a fin head plate arranged thereon and a ballast body, characterized in that a load-bearing structure of the fin is created from one or more extruded profiles.

The fin device, characterized in that profiles using welds are joined to one another.

The fin device, characterized in that the pipes are connected to one another using toggle plates or by plates running at least approximately parallel to the pipes connected by means of welds.

The fin device, characterized by a welding collar on the fin head plate by means of which the profiles are welded to the fin head plate.

The fin device, characterized in that the profiles are welded to planking on the fin such that the planking is preferably provided with shapes on their outer surface protruding away from the latter, welded connections being created on them between the planking and the respective profile.

A design and structure consisting of keel boxes and guide plate, characterized in that the guide plate and the keel box form a linear guide which is replaceable from above in the retracted state of the retractable keel.

The retractable keel apparatus for a ship, in particular for a sailboat, having a lift device for a lowerable and retractable fin device, provided with a fin and a fin head plate arranged on it, the fin head plate coming to rest against a keel receptacle which is provided for permanent connection to a ship's hull when the fin is lowered, the keel receptacle also being provided with a locking device with which a releasable lock can be created between the fin head plate and the keel receptacle (5), characterized in that in the event of a crash the flow of force runs from the fin in its fin head and then via the locking device into the keel receptacle and into the hull of the ship.

The retractable keel apparatus for a ship, in particular for a sailboat which has a lift device for a lowerable and retractable fin device, which is equipped with a fin (4) and a fin head plate (20) which is arranged on the former such that, when the fin is lowered, the fin head plate comes to rest against a keel receptacle (5) which is provided for permanent connection to a ship's hull, said keel receptacle also being provided with a locking mechanism with which a releasable lock can be created between the fin head plate (20) and the keel receptacle (5), characterized by a guide of the fin (4) with the prestressed guide element, in particular adjustable prestressed guide element in contact with the fin.

The retractable keel apparatus, characterized by centering of the fin which can be produced by means of the adjustable guide elements.

The retractable keel apparatus, characterized in that a plurality of the adjustable guide elements in the area of the front end face of the fin and a plurality of guide elements in the area of the rear end face of the fin are in contact with the latter with respect to the direction of travel provided for the ship.

The retractable keel apparatus for a ship, in particular for a sailboat which has a lift device for a lowerable and retractable fin device, which is equipped with a fin (4) and a fin head plate (20) which is arranged on the former such that, when the fin is lowered, the fin head plate comes to rest against a keel receptacle (5) which is provided for permanent connection to a ship's hull, said keel receptacle also being provided with a locking mechanism with which a releasable lock can be created between the fin head plate (20) and the keel receptacle (5), characterized by a ballast body, which is in form-fitting contact with the keel receptacle when the fin is retracted.

The invention claimed is:

1. A retractable keel apparatus for a ship, in particular for a sailboat which has a lift device for a lowerable and retractable fin device, which is equipped with a fin and a fin head plate which is arranged on the fin such that, when the fin is lowered, the fin head plate comes to rest against a keel receptacle which is provided for permanent connection to a hull of the ship, said keel receptacle being provided with a locking mechanism with which a releasable lock can be created between the fin head plate and the keel receptacle, the retractable keep apparatus, comprising:

a form-fitting connection between the fin device and the keel receptacle in an extracted state of the fin device as well as by the locking device with which the fin head plate is held in a form-fitting arrangement, said locking device comprising at least one locking bar which can be brought into contact with a top side of the fin device to exert a hold down force on the fin device, which is provided with at least one vertical component.

2. The retractable keel apparatus according to claim 1, wherein said at least one locking bar comprises a means for pressing the fin device into an ideal position for locking when said fin device has been extracted too far in a downward direction.

3. The retractable keel apparatus according to claim 2, wherein the locking device is provided in the extracted state of the fin device for releasable operative connection of the fin device with a bottom group of the hull of the ship, said at least one locking bar comprising a bearing means for holding the fin device in a locked position.

4. The retractable keel apparatus according to claim 3, further comprising:

a releasable form-fitting pegging or screw connection between the locking device and the fin device in the extracted state, said at least one locking bar comprising an equalizing means for compensating play between the at least one locking bar and the fin device with the fin device in a locked position.

5. The retractable keel apparatus according to claim 4, wherein the at least one locking bar is pivotable between a release position and a locking position via a hydraulic cylinder, said hydraulic cylinder being located at a spaced location from a pivot axis of said at least one locking bar, wherein the locking bar grips the fin head plate with a recess in the locking position, said at least one locking bar comprising an ejection means for releasing the fin device from the locked position by lifting the fin device.

6. The retractable keel apparatus for a ship, comprising:

a lift device for a lowerable and retractable fin device, which is equipped with a fin and a fin head plate arranged thereon, the fin head plate coming to rest against a keel receptacle which is provided for a permanent connection to a hull of the ship when the fin is lowered, the keel receptacle comprising a locking device with which a releasable lock is created between the fin head plate and the keel receptacle, said locking device comprising at least one locking bar which can be brought into contact with a top side of the fin device to thereby exert a hold-down force on the fin device, which is provided with at least one vertical component.

7. The retractable keel apparatus according to claim 6, further comprising:

a device for detecting and removing water that penetrates into an area of a crank of the keel receptacle, said at least one locking bar comprising a means for pressing the fin device into an ideal position for locking when said fin device has been extracted too far in a downward direction.

8. The retractable keel apparatus according to claim 7, wherein the fin head plate has one or more pegs or bolts which in an extracted state of the retractable keel apparatus engage in holes in the keel receptacle, so that the fin head plate and the keel receptacle are pegged to one another, said at least one locking bar comprising a bearing means for holding the fin device in a locked position.

9. The retractable keel apparatus according to claim 8, wherein the keel receptacle is provided with a crank having a cross-sectional shape which at least proximately matches that of the fin, said at least one locking bar comprising an equalizing means for compensating play between the at least one locking bar and the fin device with the fin device in the locked position.

10. The retractable keel apparatus according to claim 9, wherein the fin is secured in a retracted state by means of a manually operated threaded spindle, wherein the at least one locking bar is pivotable between a release position and a locking position via a hydraulic cylinder, said hydraulic cylinder being located at a spaced location from a pivot axis of said at least one locking bar, said at least one locking bar comprising an ejection means for releasing the fin device from the locked position by lifting the fin device.

11. The retractable keel apparatus according to claim 6, wherein the lift device is connected to the fin using a loose bearing.

12. A retractable keel apparatus for a ship, comprising:

a lift device for a lowerable and retractable fin device, which is equipped with a fin and a fin head plate which is arranged on the fin such that, when the fin is lowered, the fin head plate comes to rest against a keel receptacle which is provided for permanent connection to a ship's hull, said keel receptacle comprising a locking mechanism with which a releasable lock can be created between the fin head plate and the keel receptacle, said locking device comprising at least one locking bar which can be brought into contact with a top side of the fin device to thereby exert a hold-down force on the fin device, which is provided with at least one vertical component.

13. The retractable keel apparatus according to claim 12, wherein the at least one locking bar is designed to be pivotable about a pivot axis, such that a pivoting movement of the at least one locking bar is executable as a movement that is not manually driven.

14. The retractable keel apparatus according to claim 12, wherein said at least one locking bar comprises a recess, said recess being defined by at least three partial surfaces of said at least one locking bar, said at least three partial surfaces being arranged one after another, said at least three partial surfaces comprising an equalizing surface, a bearing surface and a collecting surface, said equalizing surface extending from a base of a groove toward an open side of the recess, said collecting surface being inclined upward such that a width of the opening of the recess increases from the bearing surface outward to the opening, said equalizing surface being inclined downward starting from the bearing surface such that a height of the recess is smaller toward the base of the groove, said at least one locking bar further comprising an ejector surface, said ejector surface defining at least a portion of said recess, said ejector surface engaging an underside of said fin head plate when said at least one locking bar moves to a release position.

15. The retractable keel apparatus according to claim 12, wherein said at least one locking bar comprises a means for pressing the fin device into an ideal position for locking when said fin device has been extracted too far in a downward direction.

16. The retractable keel apparatus according to claim 15, wherein said at least one locking bar comprises a bearing means for holding the fin device in a locked position.

17. The retractable keel apparatus according to claim 16, wherein said at least one locking bar comprises an equalizing means for compensating play between the at least one locking bar and the fin device with the fin device in the locked position.

18. The retractable keel apparatus according to claim 17, wherein the at least one locking bar is movable between a release position and a locking position via a hydraulic cylinder, said hydraulic cylinder being located at a spaced location from a pivot axis of said at least one locking bar, said at least one locking bar comprising a recess, the at least locking bar gripping the fin head plate in the locking position, wherein at least a portion of said fin head plate is arranged in said recess in the locking position, said at least one locking bar comprising an ejection means for releasing the fin device from the locked position by lifting the fin device.

19. The retractable keel apparatus according to claim 6, wherein said at least one locking bar comprises a recess, said recess being defined by at least three partial surfaces of said at least one locking bar, said at least three partial surfaces being arranged one after another, said at least three partial surfaces comprising an equalizing surface, a bearing surface and a collecting surface, said equalizing surface extending from a base of a groove toward an open side of the recess, said collecting surface being inclined upward such that a width of the opening of the recess increases from the bearing surface outward to the opening, said equalizing surface being inclined downward starting from the bearing surface such that a height of the recess is smaller toward the base of the groove, said at least one locking bar further comprising an ejector surface, said ejector surface defining at least a portion of said recess, said ejector surface engaging an underside of said fin head plate when said at least one locking bar moves to a release position.

20. The retractable keel apparatus according to claim 1, wherein said at least one locking bar comprises a recess, said recess being defined by at least three partial surfaces of said at least one locking bar, said at least three partial surfaces being arranged one after another, said at least three partial surfaces comprising an equalizing surface, a bearing surface and a collecting surface, said equalizing surface extending from a base of a groove toward an open side of the recess, said collecting surface being inclined upward such that a width of the opening of the recess increases from the bearing surface outward to the opening, said equalizing surface being inclined downward starting from the bearing surface such that a height of the recess is smaller toward the base of the groove, said at least one locking bar further comprising an ejector surface, said ejector surface defining at least a portion of said recess, said ejector surface engaging an underside of said fin head plate when said at least one locking bar moves to a release position.

* * * * *